US007644002B2

(12) United States Patent
Thumpudi et al.

(10) Patent No.: US 7,644,002 B2
(45) Date of Patent: Jan. 5, 2010

(54) MULTI-PASS VARIABLE BITRATE MEDIA ENCODING

(75) Inventors: Naveen Thumpudi, Sammamish, WA (US); Wei-Ge Chen, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 97 days.

(21) Appl. No.: 12/004,909

(22) Filed: Dec. 21, 2007

(65) Prior Publication Data

US 2008/0109230 A1 May 8, 2008

Related U.S. Application Data

(62) Division of application No. 10/623,338, filed on Jul. 18, 2003, now Pat. No. 7,343,291.

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS

| | | | |
|---|---|---|---|
| 4,051,470 | A | 9/1977 | Esteban et al. |
| 4,454,546 | A | 6/1984 | Mori |
| 4,493,091 | A | 1/1985 | Gundry |
| 4,706,260 | A | 11/1987 | Fedele et al. |
| 4,802,224 | A | 1/1989 | Shiraki et al. |
| 4,954,892 | A | 9/1990 | Asai et al. |
| 5,043,919 | A | 8/1991 | Callaway et al. |
| 5,089,889 | A | 2/1992 | Sugiyama |
| 5,136,377 | A | 8/1992 | Johnston et al. |
| 5,235,618 | A | 8/1993 | Sakai et al. |
| 5,266,941 | A | 11/1993 | Akeley et al. |
| 5,317,672 | A | 5/1994 | Crossman et al. |

(Continued)

FOREIGN PATENT DOCUMENTS

| | | |
|---|---|---|
| WO | WO 2007/058515 | 5/2007 |

OTHER PUBLICATIONS

Advanced Television Systems Committee, "ATSC Standard: Digital Audio Compression (AC-3), Revision A," pp. 1-140 (Aug. 2001).

(Continued)

*Primary Examiner*—Susan McFadden
(74) *Attorney, Agent, or Firm*—Klarquist Sparkman, LLP

(57) ABSTRACT

An encoder uses multi-pass VBR control strategies to provide constant or relatively constant quality for VBR output while guaranteeing (within tolerance) either compressed file size or, equivalently, overall average bitrate. The control strategies include various techniques and tools, which can be used in combination or independently. For example, in a first pass, an audio encoder encodes a sequence of audio data partitioned into variable-size chunks. In a second pass, the encoder encodes the sequence according to control parameters to produce output of relatively constant quality. The encoder sets checkpoints in the second pass to adjust the control parameters and/or subsequent checkpoints. The encoder selectively considers a peak bitrate constraint to limit peak bitrate. The encoder stores auxiliary information from the first pass for use in the second pass, which increases the speed of the second pass. Finally, the encoder compares signatures for the input data to check consistency between passes.

20 Claims, 11 Drawing Sheets

U.S. PATENT DOCUMENTS 5,394,170 A 2/1995 Akeley et al.
5,398,069 A 3/1995 Huang et al.
5,400,371 A 3/1995 Natarajan
5,414,796 A 5/1995 Jacobs et al.
5,448,297 A 9/1995 Alattar et al.
5,457,495 A 10/1995 Hartung
5,467,134 A 11/1995 Laney et al.
5,533,052 A 7/1996 Bhaskar
5,570,363 A 10/1996 Holm
5,579,430 A 11/1996 Grill et al.
5,586,200 A 12/1996 Devaney et al.
5,602,959 A 2/1997 Bergstrom et al.
5,623,424 A 4/1997 Azadegan et al.
5,650,860 A 7/1997 Uz
5,654,760 A 8/1997 Ohtsuki
5,661,755 A 8/1997 Van De Kerkhof et al.
5,666,161 A 9/1997 Kohiyama et al.
5,686,964 A 11/1997 Tabatabai et al.
5,724,453 A 3/1998 Ratnakar et al.
5,742,735 A 4/1998 Eberlein et al.
5,754,974 A 5/1998 Griffin et al.
5,787,203 A 7/1998 Lee et al.
5,802,213 A 9/1998 Gardos
5,819,215 A 10/1998 Dobson et al.
5,825,310 A 10/1998 Tsutsui
5,835,149 A 11/1998 Astle
5,835,495 A 11/1998 Ferriere
5,845,243 A 12/1998 Smart et al.
5,867,230 A 2/1999 Wang et al.
5,884,039 A 3/1999 Ludwig et al.
5,886,276 A 3/1999 Levine et al.
5,926,226 A 7/1999 Proctor et al.
5,933,451 A 8/1999 Ozkan et al.
5,952,943 A 9/1999 Walsh et al.
5,982,305 A 11/1999 Taylor
5,986,712 A 11/1999 Peterson et al.
5,990,945 A 11/1999 Sinha et al.
5,995,151 A 11/1999 Naveen et al.
6,002,439 A 12/1999 Murakami et al.
6,029,126 A 2/2000 Malvar
6,049,630 A 4/2000 Wang et al.
6,058,362 A 5/2000 Malvar
6,072,831 A 6/2000 Chen
6,073,153 A 6/2000 Malvar
6,075,768 A 6/2000 Mishra
6,081,554 A 6/2000 Lee et al.
6,088,392 A 7/2000 Rosenberg
6,108,382 A 8/2000 Gringeri et al.
6,111,914 A 8/2000 Bist
6,115,689 A 9/2000 Malvar
6,141,053 A 10/2000 Saukkonen
6,160,846 A 12/2000 Chiang et al.
6,167,162 A 12/2000 Jacquin et al.
6,182,034 B1 1/2001 Malvar
6,192,075 B1 2/2001 Jeng
6,212,232 B1 4/2001 Reed et al.
6,215,820 B1 4/2001 Bagni et al.
6,223,162 B1 4/2001 Chen et al.
6,226,407 B1 5/2001 Zabih et al.
6,240,380 B1 5/2001 Malvar
6,243,497 B1 6/2001 Chiang et al.
6,259,739 B1 7/2001 Kondo
6,278,735 B1 8/2001 Mohsenian
6,320,825 B1 11/2001 Bruekers et al.
6,351,226 B1 2/2002 Saunders et al.
6,370,502 B1 4/2002 Wu et al.
6,421,738 B1 7/2002 Ratan et al.
6,421,739 B1 7/2002 Holiday
6,441,754 B1 8/2002 Wang et al.
6,473,409 B1 10/2002 Malvar
6,490,554 B2 12/2002 Endo et al.
6,493,388 B1 12/2002 Wang
6,501,798 B1 12/2002 Sivan
6,522,693 B1 2/2003 Lu et al.
6,539,124 B2 3/2003 Sethuraman et al.
6,573,915 B1 6/2003 Sivan et al.
6,574,593 B1 6/2003 Gao et al.
6,625,321 B1 9/2003 Li et al.
6,628,712 B1 9/2003 Le Maguet
6,654,417 B1 11/2003 Hui
6,654,419 B1 11/2003 Sriram et al.
6,728,317 B1 4/2004 Demos
6,732,071 B2 5/2004 Lopez-Estrada et al.
6,760,598 B1 7/2004 Kurjenniemi
6,789,123 B2 9/2004 Li et al.
6,810,083 B2 10/2004 Chen et al.
6,876,703 B2 4/2005 Ismaeil et al.
6,895,050 B2 5/2005 Lee
6,934,677 B2 8/2005 Chen et al.
6,937,770 B1 8/2005 Oguz et al.
6,980,695 B2 12/2005 Mehrotra
7,016,409 B2 3/2006 Unger
7,023,915 B2 4/2006 Pian
7,027,982 B2 4/2006 Chen et al.
7,054,365 B2 5/2006 Kim et al.
7,143,030 B2 11/2006 Chen et al.
7,146,313 B2 12/2006 Chen et al.
7,184,959 B2 2/2007 Gibbon
7,260,525 B2 8/2007 Chen et al.
7,263,482 B2 8/2007 Chen et al.
7,283,966 B2 10/2007 Zhang et al.
7,343,291 B2 * 3/2008 Thumpudi et al. ..... 704/500
7,383,180 B2 * 6/2008 Thumpudi et al. ..... 704/229
2002/0143556 A1 10/2002 Kadatch
2002/0154693 A1 10/2002 Demos
2002/0176624 A1 11/2002 Kostrzewski et al.
2003/0110236 A1 6/2003 Yang et al.
2003/0115041 A1 6/2003 Chen
2003/0115042 A1 6/2003 Chen
2003/0115050 A1 6/2003 Chen
2003/0115051 A1 6/2003 Chen
2003/0115052 A1 6/2003 Chen
2003/0125932 A1 7/2003 Wang et al.
2003/0172131 A1 9/2003 Ao
2004/0098748 A1 5/2004 Bo et al.
2004/0172478 A1 9/2004 Jacobs
2005/0002453 A1 1/2005 Chang et al.
2005/0015259 A1 1/2005 Thumpudi et al.
2005/0015528 A1 1/2005 Du
2005/0047503 A1 3/2005 Han et al.
2005/0066063 A1 3/2005 Grigorovitch
2005/0076136 A1 4/2005 Cho
2005/0084015 A1 4/2005 Han et al.
2005/0084166 A1 4/2005 Boneh et al.
2005/0105815 A1 5/2005 Zhang et al.
2005/0123058 A1 6/2005 Greenbaum
2005/0135484 A1 6/2005 Lee
2005/0157784 A1 7/2005 Tanizawa et al.
2006/0029065 A1 2/2006 Fellman
2006/0062302 A1 3/2006 Yin et al.
2006/0088094 A1 4/2006 Cieplinski
2006/0136597 A1 6/2006 Shabtai et al.
2006/0165166 A1 7/2006 Chou
2006/0235883 A1 10/2006 Krebs et al.
2007/0100891 A1 5/2007 Nee
2007/0274383 A1 11/2007 Yu et al.
2007/0276954 A1 11/2007 Chan et al.
2008/0022005 A1 1/2008 Wu et al.

OTHER PUBLICATIONS

Baron et al, "Coding the Audio Signal," *Digital Image and Audio Communications*, pp. 101-128 (1998).

Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).
Caetano et al., "Rate Control Strategy for Embedded Wavelet Video Coders," *Electronic Letters*, pp. 1815-1817 (Oct. 14, 1999).
Cheung et al., "A Comparison of Scalar Quantization Strategies for Noisy Data Channel Data Transmission," *IEEE Transactions on Communications*, vol. 43, No. 2/3/4, pp. 738-742 (Apr. 1995).
Crisafulli et al., "Adaptive Quantization: Solution via Nonadaptive Linear Control," *IEEE Transactions on Communications*, vol. 41, pp. 741-748 (May 1993).
Dalgic et al., "Characterization of Quality and Traffic for Various Video Encoding Schemes and Various Encoder Control Schemes," Technical Report No. CSL-TR-96-701 (Aug. 1996).
De Luca, "AN1090 Application Note: STA013 MPEG 2.5 Layer III Source Decoder," *STMicroelectronics*, 17 pp. (1999).
de Queiroz et al., "Time-Varying Lapped Transforms and Wavelet Packets," *IEEE Transactions on Signal Processing*, vol. 41, pp. 3293-3305 (1993).
"DivX Multi Standard Video Encoder," 2 pp. (Downloaded from the World Wide Web on Jan. 24, 2006).
Dolby Laboratories, "AAC Technology," 4 pp. [Downloaded from the web site aac-audio.com on World Wide Web on Nov. 21, 2001].
Fraunhofer-Gesellschaft, "MPEG Audio Layer-3," 4 pp. [Downloaded from the World Wide Web on Oct. 24, 2001].
Fraunhofer-Gesellschaft, "MPEG-2 AAC," 3 pp. [Downloaded from the World Wide Web on Oct. 24, 2001].
Gibson et al, *Digital Compression for Multimedia*, Chapter 4, "Quantization," pp. 113-138 (1998).
Gibson et al., *Digital Compression for Multimedia*, Chapter 7, "Frequency Domain Coding," Morgan Kaufman Publishers, Inc., pp. iii., v-xi, and 227-262 (1998).
Gibson et al., *Digital Compression for Multimedia*, Chapter 8, "Frequency Domain Speech and Audio Coding Standards," Morgan Kaufman Publishers, Inc., pp. 263-290 (1998).
Gibson et al., *Digital Compression for Multimedia*, Chapter 11.4, "MPEG Audio," Morgan Kaufman Publishers, Inc., pp. 398-402 (1998).
Gibson et al., *Digital Compression for Multimedia*, Chapter 11.6.2-11.6.4, "More MPEG," Morgan Kaufman Publishers, Inc., pp. 415-416 (1998).
Gill et al., "Creating High-Quality Content with Microsoft Windows Media Encoder 7," 4 pp. (2000). [Downloaded from the World Wide Web on May 1, 2002.].
Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).
Hsu et al., "Joint Selection of Source and Channel Rate for VBR Video Transmission Under ATM Policing Constraints," IEEE Journal on Selected Areas in Communications, vol. 15, No. 6, pp. 1016-1028 (Aug. 1997).
ISO, "MPEG-4 Video Verification Model version 18.0," ISO/IEC JTC1/SC29/WG11 N3908, Pisa, pp. 1-10, 299-311 (Jan. 2001).
ISOI/IEC, "Information Technology—Coding of Audio-Visual Objects: Visual, ISO/IEC 14496-2, Committee Draft," 330 pp. (1998).
ISO/IEC, "ISO/IEC 11172-2: Information Technology—Coding of Moving Pictures and Associatged Audio for Storage Medua at up to About 1.5 Mbit/s," 122 pp. (1993).
ISO/IEC 11172-3, Information Technology—Coding of Moving Pictures and Associated Audio for Digital Storage Media at Up to About 1.5 Mbit/s—Part 3 Audio, 154 pp, (1993).
ISO/IEC 13818-7, "Information Technology-Generic Coding of Moving Pictures and Associated Audio Information," Part 7: Advanced Audio Coding (AAC), pp. i-iv, 1-145 (1997).
ISO/IEC 13818-7, Technical Corrigendum 1, "Information Technology-Generic Coding of Moving Pictures and Associated Audio Information," Part 7: Advanced Audio Coding (AAC), Technical Corrigendum, pp. 1-22 (1997).
ITU-T, "ITU-T Recommendation H.261: Video Codec for Audiovisual Services at *p* x 64 kbits," 28 pp. (1993).
ITU-T, "ITU-T Recommendation H.262: Information Technology—Generic Coding of Moving Pictures and Associated Audio Information: Video," 218 pp. (1995).
ITU-T, "ITU-T Recommendation H.263: Video Coding for Low Bit Rate Communication," 167 pp. (1998).
ITU, Recommendation ITU-R BS 1115, Low Bit-Rate Audio Coding, 9 pp. (1994).
ITU, Recommendation ITU-R BS 1387, Method for Objective Measurements of Perceived Audio Quality, 89 pp. (1998).
Jafarkhani et al., "Entropy-Constrained Successively Refinable Scalar Quantization," *IEEE Data Compression Conference*, pp. 337-346 (1997).
Jayant et al., "Digital Coding of Waveforms, Principles and Applications to Speech and Video," Prentice Hall, pp. 428-445 (1984).
Joint Video Team of ISO/IEC MPEG and ITU-T VCEG, "Committee Draft of Joint Video Specification (ITU-T Recommendation H.264, ISO/IEC 14496-10 AVC," 142 pp. (Aug. 2002).
Kondoz, *Digital Speech: Coding for Low Bit Rate Communications Systems*, "Chapter 3.3: Linear Predictive Modeling of Speech Signals," and "Chapter 4: LPC Parameter Quantisation Using LSFs," John Wiley & Sons, pp. 42-53 and 79-97 (1994).
Li et al., "Optimal Linear Interpolation Coding for Server-Based Computing," *Proc. IEEE Int'l Conf. on Communications*, 5 pp. (2002).
Mook, "Next-Gen Windows Media Player Leaks to the Web," *BetaNews*, 17 pp. (Jul. 19, 2002) [Downloaded from the World Wide Web on Aug. 8, 2003].
Naveen et al., "Subband Finite State Scalar Quantization," *IEEE Transactions on Image Processing*, vol. 5, No. 1, pp. 150-155 (Jan. 1996).
Opticom GmbH, "Objective Perceptual Measurement," 14 pp. [Downloaded from the World Wide Web on Oct. 24, 2001].
Ortega et al., "Adaptive Scalar Quantization Without Side Information," *IEEE Transactions on Image Processing*, vol. 6, No. 5, pp. 665-676 (May 1997).
Ortega et al., "Optimal Buffer-Constrained Source Quantization and Fast Approximation," *IEEE*, pp. 192-195 (1992).
Pao, "Encoding Stored Video for Streaming Applications," IEEE Transactions on Circuits and Systems for Video Technology, vol. 11, No. 2, pp. 199-209 (Feb. 2001).
Phamdo, "Speech Compression," 13 pp. [Downloaded from the World Wide Web on Nov. 25, 2001].
Printouts of FTP directories from http://ftp3.itu.ch, 8 pp. (downloaded from the World Wide Web on Sep. 20, 2005).
Ramchandran et al., "Bit Allocation for Dependent Quantization with Applications to MPEG Video Coders," *IEEE*, pp. v-381-v-384 (1993).
Ratnakar et al., "RD-OPT: An Efficient Algorithm for Optimization DCT Quantization Tables," 11 pp.
Reader, "History of MPEG Video Compression—Ver. 4.0," 99 pp. (document marked Dec. 16, 2003).
Reed et al., "Constrained Bit-Rate Control for Very Low Bit-Rate Streaming-Video Applications," *IEEE Transactions on Circuits and Systems for Video Technology*, vol. 11, No. 7, pp. 882-889 (Jul. 2001).
Reibman et al., "Constraints on Variable Bit-rate Video for ATM Networks," IEEE Transactions on Circuits and Systems for Video Technology, No. 4, pp. 361-372 (1992).
Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).
Ronda et al., "Rate Control and Bit Allocation for MPEG-4," *IEEE Transactions on Circuits and Systems for Video Technology*, pp. 1243-1258 (1999).
Schaar-Mitrea et al., "Hybrid Compression of Video with Graphics in DTV Communications Systems," *IEEE Trans. On Consumer Electronics*, pp. 1007-1017 (2000).
Schuster et al., "A Theory for the Optimal Bit Allocation Between Displacement Vector Field and Displaced Frame Difference," *IEEE J. on Selected Areas in Comm.*, vol. 15, No. 9, pp. 1739-1751 (Dec. 1997).
Sheu et al., "A Buffer Allocation Mechanism for VBR Video Playback," Communication Tech. Proc. 2000, WCC-ICCT 2000, vol. 2, pp. 1641-1644 (2000).

Sidiropoulos, "Optimal Adaptive Scalar Quantization and image Compression," *ICIP*, pp. 574-578 (1998).
Solari, *Digital Video and Audio Compression*, Title Page, Contents, "Chapter 8: Sound and Audio," McGraw-Hill, Inc., pp. iii, v-vi, and 187-211 (1997).
Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).
Sullivan, "Optimal Entropy Constrained Scalar Quantization for Exponential and Laplacian Random Variables," *ICASSP*, pp. V-265-V-268 (1994).
Sullivan et al., "Rate-Distortion Optimization for Video Compression," *IEEE Signal Processing Magazine*, pp. 74-90 (Nov. 1998).
Sullivan et al., "The H.264/AVC Advanced Video Coding Standard: Overview and Introduction to the Fidelity Range Extensions," 21 pp. (Aug. 2004).
Tao et al., "Adaptive Model-driven Bit Allocation for MPEG Video Coding," *IEEE Transactions on Circuits and Systems for Video Tech*., vol. 10, No. 1, pp. 147-157 (Feb. 2000).
Trushkin, "On the Design on an Optimal Quantizer," *IEEE Transactions on Information Theory*, vol. 39, No. 4, pp. 1180-1194 (Jul. 1993).
Tsang et al., "Fuzzy based rate control for real-time MPEG video," 12 pp.
Vetro et al., "An Overview of MPEG-4 Object-Based Encoding Algorithms," *IEEE International Symposium on Information Technology*, pp. 366-369 (2001).
Walpole et al., "A Player for Adaptive MPEG Video Streaming over the Internet," Proc. SPIE, vol. 3240, pp. 270-281 (1998).
Westerink et al., "Two-pass MPEG-2 Variable-bit-rate Encoding," *IBM J. Res. Develop*., vol. 43, No. 4, pp. 471-488 (1999).
Wong, "Progressively Adaptive Scalar Quantization," *ICIP*, pp. 357-360 (1996).
Wu et al., "Entropy-Constrained Scalar Quantization and Minimum Entropy with Error Bound by Discrete Wavelet Transforms in Image Compression," *IEEE Transactions on Image Processing*, vol. 48, No. 4, pp. 1133-1143 (Apr. 2000).
Wu et al., "Quantizer Monotonicities and Globally Optimally Scalar Quantizer Design," *IEEE Transactions on Information Theory*, vol. 39, No. 3, pp. 1049-1053 (May 1993).
Yang et al., "Rate Control for Videophone Using Local Perceptual Cues," *IEEE Transactions on Circuits and Systems for Video Tech*., vol. 15, No. 4, pp. 496-507 (Apr. 2005).
Barker et al., "Dynamic Programming Based Smoothing of VBR Video Traffic," 10 pp. (document marked Mar. 6, 2002).
Dai, "Rate-Distortion Analysis and Traffic Modeling of Scalable Video Coders," Dissertation, Texas A&M University, 172 pp. (Dec. 2004).
Girod et al., "Advances in channel-adaptive video streaming," *Wireless Communications and Mobile Computing*, 24 pp. (Sep. 2002).
Guo et al., "Practical Wyner-Ziv Switching Scheme for Multiple Bit-Rate Video Streaming," *IEEE*, pp. 249-252 (Sep. 2006).
He et al., "A Unified Rate-Distortion Analysis Framework for Transform Coding," *IEEE Transactions on Circuits and Systems for Video Technology*, vol. 11, No. 12, pp. 1221- 1236 (Dec. 2001).
Huang et al., "Optimal Control of Multiple Bit Rates for Streaming Media," *Proc. Picture Coding Symposium*, 4 pp. (Dec. 2004).
Huang et al., "Optimal Coding Rate Control of Scalable and Multi Bit Rate Streaming Media," Microsoft Research Technical Report, MSR-TR-2005-47, 26 pp. (Apr. 2005).
Johansen, "Rate-Distortion Optimization for Video Communication in Resource Constrained IP Networks," Thesis, Norwegian University of Science and Technology, 161 pp. (Dec. 2007).
Kalman et al., "Rate-Distortion Optimized Video Streaming with Adaptive Playout," *Proc. Int'l Conf. On Image Processing*, 4 pp (Jun. 2002).
Kammin et al., "Video multiplexing for the MPEG-2 VBR encoder using a deterministic method," *Second Int'l Conf. On Automated Production of Cross Media Content for Multi-Channel Distribution*, 8 pp. (Dec. 2006).
Ortega, "Optimal bit allocation under multiple rate constraints," *Proc. Of the Data Compression Conf.*, 10 pp. (Apr. 1996).
Ortega et al., "Optimal Trellis-based Buffered Compression and Fast Approximation," *IEEE Transactions on Image Processing*, vol. 3, No. 1, pp. 26-40 (Jan. 1994).
Rexford et al., "Online Smoothing of Live, Variable-Bit-Rate Video," *IEEE*, pp. 235-243 (May 1997).

* cited by examiner

Figure 1,
Prior Art

Figure 2,
Prior Art

MULTI-PASS VARIABLE BITRATE MEDIA ENCODING

RELATED APPLICATION DATA

The present application is a divisional of U.S. patent application Ser. No. 10/623,338, filed Jul. 18, 2003, the disclosure of which is hereby incorporated by reference.

TECHNICAL FIELD

The present invention relates to control strategies for media. For example, an audio encoder uses a two-pass variable bitrate control strategy when encoding audio data to produce variable bitrate output of uniform or relatively uniform quality.

BACKGROUND

With the introduction of compact disks, digital wireless telephone networks, and audio delivery over the Internet, digital audio has become commonplace. Engineers use a variety of techniques to control the quality and bitrate of digital audio. To understand these techniques, it helps to understand how audio information is represented in a computer and how humans perceive audio.

I. Representation of Audio Information in a Computer

A computer processes audio information as a series of numbers representing the audio information. For example, a single number can represent an audio sample, which is an amplitude (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel mode's for audio. In mono mode, audio information is present in one channel. In stereo mode, audio information is present in two channels, usually labeled the left and right channels. Other modes with more channels, such as 5-channel surround sound, are also possible. Table 1 shows several formats of audio with different quality levels, along with corresponding raw bitrate costs.

TABLE 1

Bitrates for different quality audio information

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| telephone | 8 | 11,025 | mono | 88,200 |
| CD audio | 16 | 44,100 | stereo | 1,411,200 |
| high quality audio | 16 | 48,000 | stereo | 1,536,000 |

As Table 1 shows, the cost of high quality audio information such as CD audio is high bitrate. High quality audio information consumes large amounts of computer storage and transmission capacity.

II. Processing Audio Information in a Computer

Many computers and computer networks lack the resources to process raw digital audio. Compression (also called encoding or coding) decreases the cost of storing and transmitting audio information by converting the information into a lower bitrate form. Compression can be lossless (in which quality does not suffer) or lossy (in which quality suffers but bitrate reduction from subsequent lossless compression is more dramatic). Decompression (also called decoding) extracts a reconstructed version of the original information from the compressed form.

A. Standard Perceptual Audio Encoders and Decoders

Generally, the goal of audio compression is to digitally represent audio signals to provide maximum signal quality with the least possible amount of bits. A conventional audio coder/decoder ["codec"] system uses subband/transform coding, quantization, rate control, and variable length coding to achieve its compression. The quantization and other lossy compression techniques introduce potentially audible noise into an audio signal. The audibility of the noise depends on how much noise there is and how much of the noise the listener perceives. The first factor relates mainly to objective quality, while the second factor depends on human perception of sound.

An audio encoder can use various techniques to provide the best possible quality for a given bitrate, including transform coding, modeling human perception of audio, and rate control. As a result of these techniques, an audio signal can be more heavily quantized at selected frequencies or times to decrease bitrate, yet the increased quantization will not significantly degrade perceived quality for a listener.

FIG. 1 shows a generalized diagram of a transform-based, perceptual audio encoder (100) according to the prior art. FIG. 2 shows a generalized diagram of a corresponding audio decoder (200) according to the prior art. Though the codec system shown in FIGS. 1 and 2 is generalized, it has characteristics found in several real world codec systems, including versions of Microsoft Corporation's Windows Media Audio ["WMA"] encoder and decoder, in particular WMA version 8 ["WMA8"]. Other codec systems are provided or specified by the Motion Picture Experts Group, Audio Layer 3 ["MP3"] standard, the Motion Picture Experts Group 2, Advanced Audio Coding ["AAC"] standard, and Dolby AC3. For additional information about these other codec systems, see the respective standards or technical publications.

1. Perceptual Audio Encoder

Overall, the encoder (100) receives a time series of input audio samples (105), compresses the audio samples (105) in one pass, and multiplexes information produced by the various modules of the encoder (100) to output a bitstream (195) at a constant or relatively constant bitrate. The encoder (100) includes a frequency transformer (110), a multi-channel transformer (120), a perception modeler (130), a weighter (140), a quantizer (150), an entropy encoder (160), a controller (170), and a bitstream multiplexer ["MUX"] (180).

The frequency transformer (110) receives the audio samples (105) and converts them into data in the frequency domain. For example, the frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. For multi-channel audio, the frequency transformer (110) uses the same pattern of windows for each channel in a particular frame. The frequency transformer (110) outputs blocks of frequency coefficient data to the multi-channel transformer (120) and outputs side information such as block sizes to the MUX (180).

Transform coding techniques convert information into a form that makes it easier to separate perceptually important information from perceptually unimportant information. The less important information can then be quantized heavily, while the more important information is preserved, so as to provide the best perceived quality for a given bitrate.

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2}, \text{ and} \quad (1)$$

$$X_{Diff}[k] = \frac{X_{Left}[k] - X_{Right}[k]}{2}. \quad (2)$$

Or, the multi-channel transformer (120) can pass the left and right channels through as independently coded channels. The decision to use independently or jointly coded channels is predetermined or made adaptively during encoding. For example, the encoder (100) determines whether to code stereo channels jointly or independently with an open loop selection decision that considers the (a) energy separation between coding channels with and without the multi-channel transform and (b) the disparity in excitation patterns between the left and right input channels. Such a decision can be made on a window-by-window basis or only once per frame to simplify the decision. The multi-channel transformer (120) produces side information to the MUX (180) indicating the channel mode used.

The encoder (100) can apply multi-channel rematrixing to a block of audio data after a multi-channel transform. For low bitrate, multi-channel audio data in jointly coded channels, the encoder (100) selectively suppresses information in certain channels (e.g., the difference channel) to improve the quality of the remaining channel(s) (e.g., the sum channel). For example, the encoder (100) scales the difference channel by a scaling factor ρ:

$$\tilde{X}_{Diff}[k]=\rho \cdot X_{Diff}[k] \quad (3),$$

where the value of ρ is based on: (a) current average levels of a perceptual audio quality measure such as Noise to Excitation Ratio ["NER"], (b) current fullness of a virtual buffer, (c) bitrate and sampling rate settings of the encoder (100), and (d) the channel separation in the left and right input channels.

The perception modeler (130) processes audio data according to a model of the human auditory system to improve the perceived quality of the reconstructed audio signal for a given bitrate. For example, an auditory model typically considers the range of human hearing and critical bands. The human nervous system integrates sub-ranges of frequencies. For this reason, an auditory model may organize and process audio information by critical bands. Different auditory models use a different number of critical bands (e.g., 25, 32, 55, or 109) and/or different cut-off frequencies for the critical bands. Bark bands are a well-known example of critical bands. Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. In addition, an auditory model can consider a variety of other factors relating to physical or neural aspects of human perception of sound.

Using an auditory model, an audio encoder can determine which parts of an audio signal can be heavily quantized without introducing audible distortion, and which parts should be quantized lightly or not at all. Thus, the encoder can spread distortion across the signal so as to decrease the audibility of the distortion. The perception modeler (130) outputs information that the weighter (140) uses to shape noise in the audio data to reduce the audibility of the noise. For example, using any of various techniques, the weighter (140) generates weighting factors (sometimes called scaling factors) for quantization matrices (sometimes called masks) based upon the received information. The weighting factors in a quantization matrix include a weight for each of multiple quantization bands in the audio data, where the quantization bands are frequency ranges of frequency coefficients. The number of quantization bands can be the same as or less than the number of critical bands. Thus, the weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. The weighter (140) then applies the weighting factors to the data received from the multi-channel transformer (120).

In one implementation, the weighter (140) generates a set of weighting factors for each window of each channel of multi-channel audio, or shares a single set of weighting factors for parallel windows of jointly coded channels. The weighter (140) outputs weighted blocks of coefficient data to the quantizer (150) and outputs side information such as the sets of weighting factors to the MUX (180).

A set of weighting factors can be compressed for more efficient representation using direct compression. In the direct compression technique, the encoder (100) uniformly quantizes each element of a quantization matrix. The encoder then differentially codes the quantized elements, and Huffman codes the differentially coded elements. In some cases (e.g., when all of the coefficients of particular quantization bands have been quantized or truncated to a value of 0), the decoder (200) does not require weighting factors for all quantization bands. In such cases, the encoder (100) gives values to one or more unneeded weighting factors that are identical to the value of the next needed weighting factor in a series, which makes differential coding of elements of the quantization matrix more efficient.

Or, for low bitrate applications, the encoder (100) can parametrically compress a quantization matrix to represent the quantization matrix as a set of parameters, for example, using Linear Predictive Coding ["LPC"] of pseudo-autocorrelation parameters computed from the quantization matrix.

The quantizer (150) quantizes the output of the weighter (140), producing quantized coefficient data to the entropy encoder (160) and side information including quantization step size to the MUX (180). Quantization maps ranges of input values to single values. In a generalized example, with uniform, scalar quantization by a factor of 3.0, a sample with a value anywhere between −1.5 and 1.499 is mapped to 0, a sample with a value anywhere between 1.5 and 4.499 is mapped to 1, etc. To reconstruct the sample, the quantized value is multiplied by the quantization factor, but the reconstruction is imprecise. Continuing the example started above, the quantized value 1 reconstructs to 1×3=3; it is impossible to determine where the original sample value was in the range 1.5 to 4.499. Quantization causes a loss in fidelity of the reconstructed value compared to the original value, but can dramatically improve the effectiveness of subsequent lossless compression, thereby reducing bitrate. Adjusting quantization allows the encoder (100) to regulate the quality and bitrate of the output bitstream (195) in conjunction with the controller (170). In FIG. 1, the quantizer (150) is an adaptive, uniform, scalar quantizer. The quantizer (150) applies the same quantization step size to each frequency coefficient, but the quantization step size itself can change from one iteration of a quantization loop to the next to affect quality and the bitrate of the entropy encoder (160) output. Other kinds of quantization are non-uniform quantization, vector quantization, and/or non-adaptive quantization.

The entropy encoder (160) losslessly compresses quantized coefficient data received from the quantizer (150). The entropy encoder (160) can compute the number of bits spent encoding audio information and pass this information to the rate/quality controller (170).

The controller (170) works with the quantizer (150) to regulate the bitrate and/or quality of the output of the encoder (100). The controller (170) receives information from other modules of the encoder (100) and processes the received information to determine a desired quantization step size given current conditions. The controller (170) outputs the quantization step size to the quantizer (150) with the goal of satisfying bitrate and quality constraints. U.S. patent application Ser. No. 10/017,694, filed Dec. 14, 2001, entitled "Quality and Rate Control Strategy for Digital Audio," published on Jun. 19, 2003, as Publication No. US-2003-0115050-A1, includes description of quality and rate control as implemented in an audio encoder of WMA8, as well as additional description of other quality and rate control techniques.

The encoder (100) can apply noise substitution and/or band truncation to a block of audio data. At low and mid-bitrates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands.

The MUX (180) multiplexes the side information received from the other modules of the audio encoder (100) along with the entropy encoded data received from the entropy encoder (160). The MUX (180) outputs the information in a format that an audio decoder recognizes. The MUX (180) includes a virtual buffer that stores the bitstream (195) to be output by the encoder (100).

2. Perceptual Audio Decoder

Overall, the decoder (200) receives a bitstream (205) of compressed audio information including entropy encoded data as well as side information, from which the decoder (200) reconstructs audio samples (295). The audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270).

The DEMUX (210) parses information in the bitstream (205) and sends information to the modules of the decoder (200). The DEMUX (210) includes one or more buffers to compensate for variations in bitrate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data.

From the DEMUX (210), the noise generator (240) receives information indicating which bands in a block of data are noise substituted as well as any parameters for the form of the noise. The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors, for example, entropy decoding, inverse differentially coding, and inverse quantizing the elements of the quantization matrix. The inverse weighter (250) applies the weighting factors to the partially reconstructed frequency coefficient data for bands that have not been noise substituted. The inverse weighter (250) then adds in the noise patterns received from the noise generator (240) for the noise-substituted bands.

The inverse multi-channel transformer (260) receives the reconstructed frequency coefficient data from the inverse weighter (250) and channel mode information from the DEMUX (210). If multi-channel audio is in independently coded channels, the inverse multi-channel transformer (260) passes the channels through. If multi-channel data is in jointly coded channels, the inverse multi-channel transformer (260) converts the data into independently coded channels.

The inverse frequency transformer (270) receives the frequency coefficient data output by the multi-channel transformer (260) as well as side information such as block sizes from the DEMUX (210). The inverse frequency transformer (270) applies the inverse of the frequency transform used in the encoder and outputs blocks of reconstructed audio samples (295).

III. Controlling Rate and Quality of Audio Information

Different audio applications have different quality and bitrate requirements. Certain applications require constant or relatively constant bitrate ["CBR"]. One such CBR application is encoding audio for streaming over the Internet. Other applications require constant or relatively constant quality over time for compressed audio information, resulting in variable bitrate ["VBR"] output.

The goal of a CBR encoder is to output compressed audio information at a constant bitrate despite changes in the complexity of the audio information. Complex audio information is typically less compressible than simple audio information. To meet bitrate requirements, the CBR encoder can adjust how the audio information is quantized. The quality of the compressed audio information then varies, with lower quality for periods of complex audio information due to increased quantization and higher quality for periods of simple audio information due to decreased quantization.

While adjustment of quantization and audio quality is necessary at times to satisfy CBR requirements, some CBR encoders can cause unnecessary changes in quality, which can result in thrashing between high quality and low quality around the appropriate, middle quality. Moreover, when changes in audio quality are necessary, some CBR encoders often cause abrupt changes, which are more noticeable and objectionable than smooth changes.

WMA version 7.0 ["WMA7"] includes an audio encoder that can be used for CBR encoding of audio information for streaming. The WMA7 encoder uses a virtual buffer and rate control to handle variations in bitrate due to changes in the complexity of audio information. In general, the WMA7 encoder uses one-pass CBR rate control. In a one-pass encoding scheme, an encoder analyzes the input signal and generates a compressed bit stream in the same pass through the input signal.

To handle short-term fluctuations around the constant bitrate (such as those due to brief variations in complexity), the WMA7 encoder uses a virtual buffer that stores some duration of compressed audio information. For example, the virtual buffer stores compressed audio information for 5 seconds of audio playback. The virtual buffer outputs the compressed audio information at the constant bitrate, so long as the virtual buffer does not underflow or overflow. Using the virtual buffer, the encoder can compress audio information at relatively constant quality despite variations in complexity, so long as the virtual buffer is long enough to smooth out the variations. In practice, virtual buffers must be limited in duration in order to limit system delay, however, and buffer underflow or overflow can occur unless the encoder intervenes.

To handle longer-term deviations from the constant bitrate (such as those due to extended periods of complexity or silence), the WMA7 encoder adjusts the quantization step size of a uniform, scalar quantizer in a rate control loop. The relation between quantization step size and bitrate is complex and hard to predict in advance, so the encoder tries one or more different quantization step sizes until the encoder finds one that results in compressed audio information with a bitrate sufficiently close to a target bitrate. The encoder sets the target bitrate to reach a desired buffer fullness, preventing buffer underflow and overflow. Based upon the complexity of the audio information, the encoder can also allocate additional bits for a block or deallocate bits when setting the target bitrate for the rate control loop.

The WMA7 encoder measures the quality of the reconstructed audio information for certain operations (e.g., deciding which bands to truncate). The WMA7 encoder does not use the quality measurement in conjunction with adjustment of the quantization step size in a quantization loop, however.

The WMA7 encoder controls bitrate and provides good quality for a given bitrate, but can cause unnecessary quality changes. Moreover, with the WMA7 encoder, necessary changes in audio quality are not as smooth as they could be in transitions from one level of quality to another.

U.S. patent application Ser. No. 10/017,694 includes description of quality and rate control as implemented in the WMA8 encoder, as well as additional description of other quality and rate control techniques. In general, the WMA8 encoder uses one-pass CBR quality and rate control, with complexity estimation of future frames. For additional detail, see U.S. patent application Ser. No. 10/017,694.

The WMA8 encoder smoothly controls rate and quality, and provides good quality for a given bitrate. As a one-pass encoder, however, the WMA8 encoder relies on partial and incomplete information about future frames in an audio sequence.

Numerous other audio encoders use rate control strategies. For example, see U.S. Pat. No. 5,845,243 to Smart et al. Such rate control strategies potentially consider information other than or in addition to current buffer fullness, for example, the complexity of the audio information.

Several international standards describe audio encoders that incorporate distortion and rate control. The MP3 and AAC standards each describe techniques for controlling distortion and bitrate of compressed audio information.

In MP3, the encoder uses nested quantization loops to control distortion and bitrate for a block of audio information called a granule. Within an outer quantization loop for controlling distortion, the MP3 encoder calls an inner quantization loop for controlling bitrate.

In the outer quantization loop, the MP3 encoder compares distortions for scale factor bands to allowed distortion thresholds for the scale factor bands. A scale factor band is a range of frequency coefficients for which the encoder calculates a weight called a scale factor. Each scale factor starts with a minimum weight for a scale factor band. After an iteration of the inner quantization loop, the encoder amplifies the scale factors until the distortion in each scale factor band is less than the allowed distortion threshold for that scale factor band, with the encoder calling the inner quantization loop for each set of scale factors. In special cases, the encoder exits the outer quantization loop even if distortion exceeds the allowed distortion threshold for a scale factor band (e.g., if all scale factors have been amplified or if a scale factor has reached a maximum amplification).

In the inner quantization loop, the MP3 encoder finds a satisfactory quantization step size for a given set of scale factors. The encoder starts with a quantization step size expected to yield more than the number of available bits for the granule. The encoder then gradually increases the quantization step size until it finds one that yields fewer than the number of available bits.

The MP3 encoder calculates the number of available bits for the granule based upon the average number of bits per granule, the number of bits in a bit reservoir, and an estimate of complexity of the granule called perceptual entropy. The bit reservoir counts unused bits from previous granules. If a granule uses less than the number of available bits, the MP3 encoder adds the unused bits to the bit reservoir. When the bit reservoir gets too full, the MP3 encoder preemptively allocates more bits to granules or adds padding bits to the compressed audio information. The MP3 encoder uses a psychoacoustic model to calculate the perceptual entropy of the granule based upon the energy, distortion thresholds, and widths for frequency ranges called threshold calculation partitions. Based upon the perceptual entropy, the encoder can allocate more than the average number of bits to a granule.

For additional information about MP3 and AAC, see the MP3 standard ("ISO/IEC 111172-3, Information Technology—Coding of Moving Pictures and Associated Audio for Digital Storage Media at Up to About 1.5 Mbit/s—Part 3: Audio") and the AAC standard.

Other audio encoders use a combination of filtering and zero tree coding to jointly control quality and bitrate, in which an audio encoder decomposes an audio signal into bands at different frequencies and temporal resolutions. The encoder formats band information such that information for less perceptually important bands can be incrementally removed from a bitstream, if necessary, while preserving the most information possible for a given bitrate. For more information about zero tree coding, see Srinivasan et al., "High-Quality Audio Compression Using an Adaptive Wavelet Packet Decomposition and Psychoacoustic Modeling," IEEE Transactions on Signal Processing, Vol. 46, No. 4, pp. (April 1998).

Outside of the field of audio encoding, various joint quality and bitrate control strategies for video encoding have been published. For example, see U.S. Pat. No. 5,686,964 to Naveen et al.; U.S. Pat. No. 5,995,151 to Naveen et al.; Caetano et al., "Rate Control Strategy for Embedded Wavelet Video Coders," IEEE Electronics Letters, pp 1815-17 (Oct. 14, 1999); Ribas-Corbera et al., "Rate Control in DCT Video Coding for Low-Delay Communications," IEEE Trans Circuits and Systems for Video Tech., Vol. 9, No 1, (February 1999); and Westerink et al., "Two-pass MPEG-2 Variable Bit Rate Encoding," IBM Journal of Res. Dev., Vol. 43, No. 4 (July 1999).

The Westerink article describes a two-pass VBR control strategy for video compression. As such, the control strategy described therein cannot be simply applied to other types of media such as audio. For one thing, the video input in the Westerink article is partitioned at regular times into uniformly sized video frames. The Westerink article does not describe how to perform two-pass VBR control for media with variable-size encoding units. Also, for video coding, there are reasonable models relating quantization step size to quality and step size to bits, as used in the Westerink article. These models cannot be simply applied to audio data in many cases, however, due to the erratic step-rate-distortion performance of audio data.

As one might expect given the importance of quality and rate control to encoder performance, the fields of quality and rate control are well developed. Whatever the advantages of previous quality and rate control strategies, however, they do not offer the performance advantages of the present invention.

SUMMARY

The present invention relates to strategies for controlling the quality and bitrate of media such as audio data. For example, with a multi-pass VBR control strategy, an audio encoder provides constant or relatively constant quality for VBR output. This improves the overall listening experience and makes computer systems a more compelling platform for creating, distributing, and playing back high quality stereo and multi-channel audio. The multi-pass VBR control strategies described herein include various techniques and tools, which can be used in combination or independently.

According to a first aspect of the control strategies described herein, in a first pass, an audio encoder encodes a sequence of audio data. In a second pass, the encoder encodes the sequence in view of a target quality level to produce VBR output. The target quality level is based at least in part upon statistics gathered from the encoding in the first pass. In this way, the produces output of uniform or relatively uniform quality.

According to a second aspect of the control strategies described herein, an encoder uses a multi-pass VBR control strategy to encode media data partitioned into variable-size chunks for encoding. In a second pass, the encoder encodes the media data according to one or more control parameters determined by processing the results of encoding in a first pass. By working with variable-size chunks, the encoder can apply its multi-pass VBR control strategy to media such as audio.

According to a third aspect of the control strategies described herein, an encoder sets checkpoints for second pass encoding in a multi-pass control strategy. For example, the encoder sets checkpoints at regularly spaced points (10%, 20%, etc.) of a number of bits allocated to a sequence of audio data. At a checkpoint in the second pass, the encoder checks results of the encoding as of the checkpoint. The encoder may then adjust a target quality level and/or adjust subsequent checkpoints based upon the results, which improves the uniformity of quality in the output.

According to a fourth aspect of the control strategies described herein, an audio encoder considers a peak bitrate constraint in multi-pass encoding. The peak bitrate constraint allows the encoder to limit the peak bitrate so that particular devices are able to handle the output. An encoder may selectively apply the peak bitrate constraint when encoding some sequences, but not other sequences.

According to a fifth aspect of the control strategies described herein, an encoder stores auxiliary information from encoding media data in a first pass. In a second pass, the encoder encodes the media data using the stored auxiliary information. This increases the speed of the encoding in the second pass.

According to a sixth aspect of the control strategies described herein, an encoder computes a signature for media data in a first pass. In a second pass, the encoder compares a signature for the media data in the second pass to the signature from the first pass, and continues encoding in the second pass if the signatures match. Otherwise, the encoder takes another action such as stopping the encoding. Thus, the encoder verifies consistency of the media data between the first and second passes.

Additional features and advantages of the invention will be made apparent from the following detailed description of embodiments that proceeds with reference to the accompanying drawings.

DETAILED DESCRIPTION

An audio encoder uses a multi-pass VBR control strategy in encoding audio information. The audio encoder adjusts quantization of the audio information to satisfy constant or relatively constant quality requirements, while also satisfying a constraint on the overall size of the compressed audio data.

The audio encoder uses several techniques in the multi-pass VBR control strategy. While the techniques are typically described herein as part of a single, integrated system, the techniques can be applied separately in quality and/or rate control, potentially in combination with other rate control strategies.

The described embodiments focus on a control strategy with two passes. The techniques and tools of the present invention may also be applied in a control strategy with more passes. In a few cases, the techniques and tools may be applied in a control strategy with a single pass.

In alternative embodiments, another type of audio processing tool implements one or more of the techniques to control the quality and/or bitrate of audio information. Moreover, although described embodiments focus on audio applications, in alternative embodiments, a video encoder, other media encoder, or other tool applies one or more of the techniques to control the quality and/or bitrate in a multi-pass control strategy.

I. Computing Environment

Figure 3:
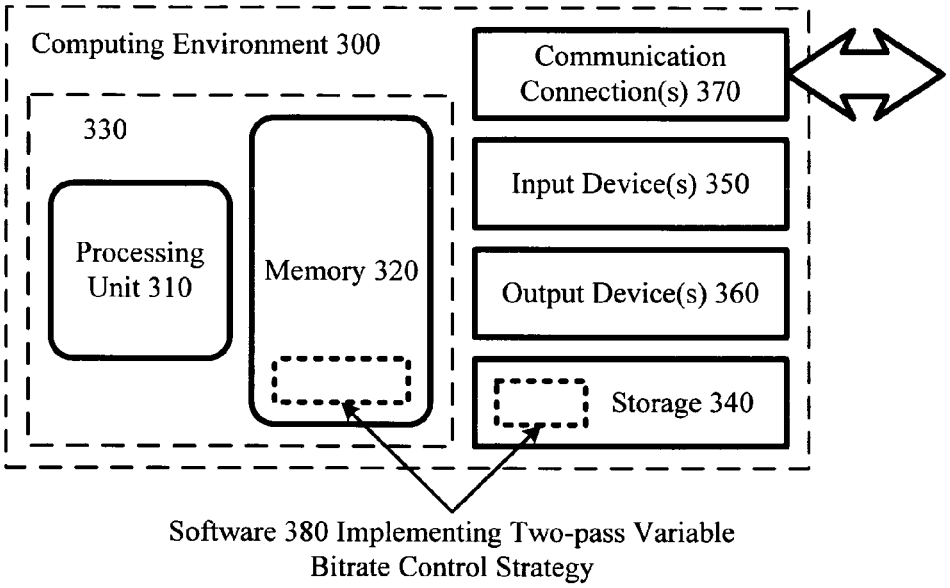
FIG. 3 is a block diagram of a suitable computing environment.

FIG. 3 illustrates a generalized example of a suitable computing environment (300) in which described embodiments may be implemented. The computing environment (300) is not intended to suggest any limitation as to scope of use or functionality of the invention, as the present invention may be implemented in diverse general-purpose or special-purpose computing environments.

With reference to FIG. 3, the computing environment (300) includes at least one processing unit (310) and memory (320). In FIG. 3, this most basic configuration (330) is included within a dashed line. The processing unit (310) executes computer-executable instructions and may be a real or a virtual processor. In a multi-processing system, multiple processing units execute computer-executable instructions to increase processing power. The memory (320) may be volatile memory (e.g., registers, cache, RAM), non-volatile memory (e.g., ROM, EEPROM, flash memory, etc.), or some combination of the two. The memory (320) stores software (380) implementing an audio encoder with a two-pass VBR control strategy.

A computing environment may have additional features. For example, the computing environment (300) includes storage (340), one or more input devices (350), one or more output devices (360), and one or more communication connections (370). An interconnection mechanism (not shown) such as a bus, controller, or network interconnects the components of the computing environment (300). Typically, operating system software (not shown) provides an operating environment for other software executing in the computing environment (300), and coordinates activities of the components of the computing environment (300).

The storage (340) may be removable or non-removable, and includes magnetic disks, magnetic tapes or cassettes, CD-ROMs, CD-RWs, DVDs, or any other medium which can be used to store information and which can be accessed within the computing environment (300). The storage (340) stores instructions for the software (380) implementing the audio encoder with a two-pass VBR control strategy.

The input device(s) (350) may be a touch input device such as a keyboard, mouse, pen, or trackball, a voice input device, a scanning device, or another device that provides input to the computing environment (300). For audio, the input device(s) (350) may be a sound card or similar device that accepts audio input in analog or digital form, or a CD-ROM or CD-RW that provides audio samples to the computing environment. The output device(s) (360) may be a display, printer, speaker, CD-writer, or another device that provides output from the computing environment (300).

The communication connection(s) (370) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (300), computer-readable media include memory (320), storage (340), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Exemplary Audio Encoders and Decoders

Figure 4:
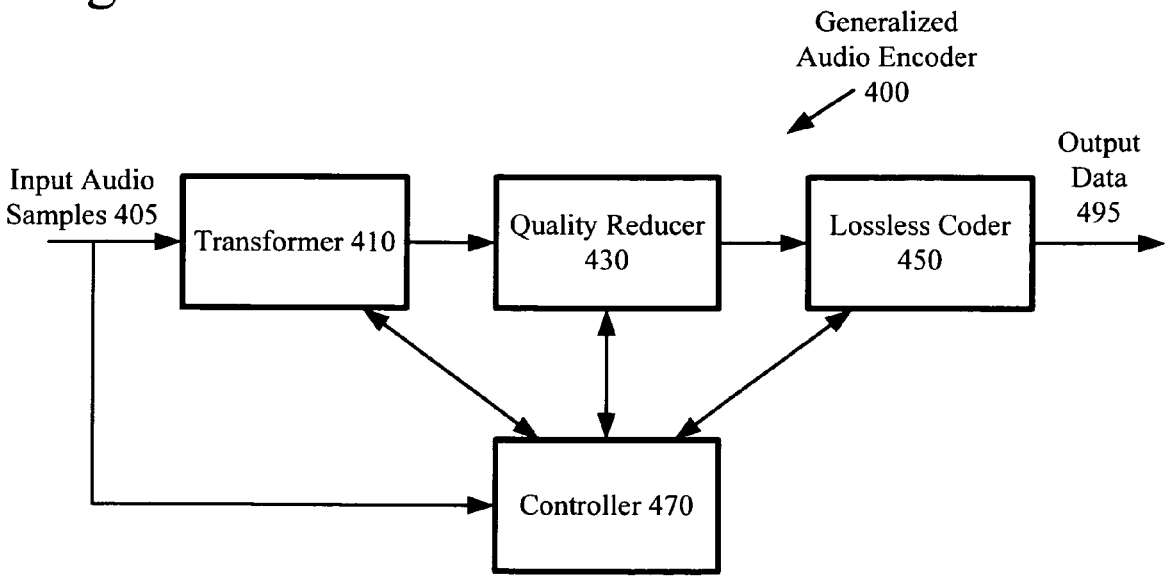
FIG. 4 is a block diagram of generalized audio encoder for one-pass encoding.
Figure 5:
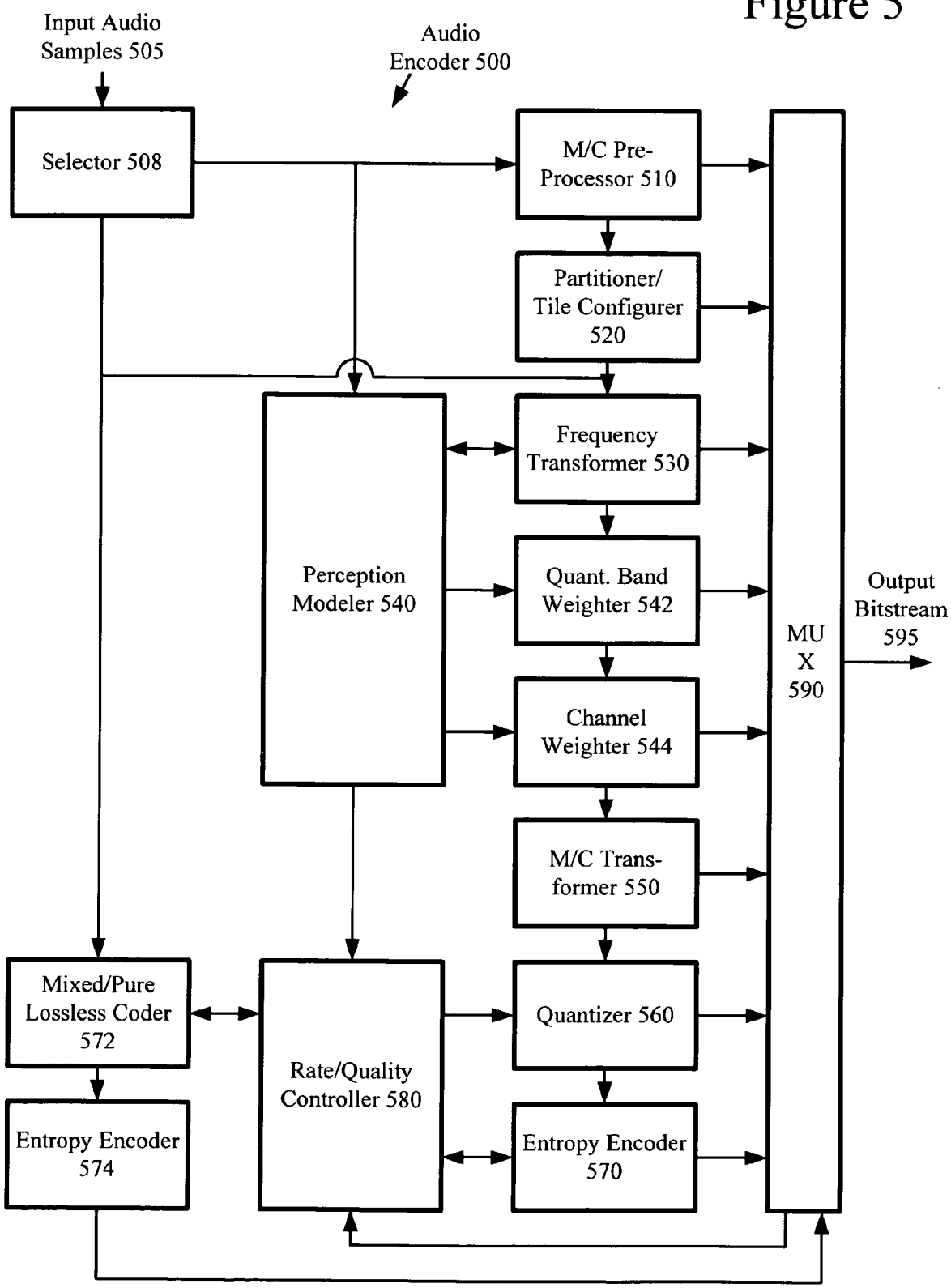
FIG. 5 is a block diagram of a particular audio encoder for one-pass encoding.
Figure 6:
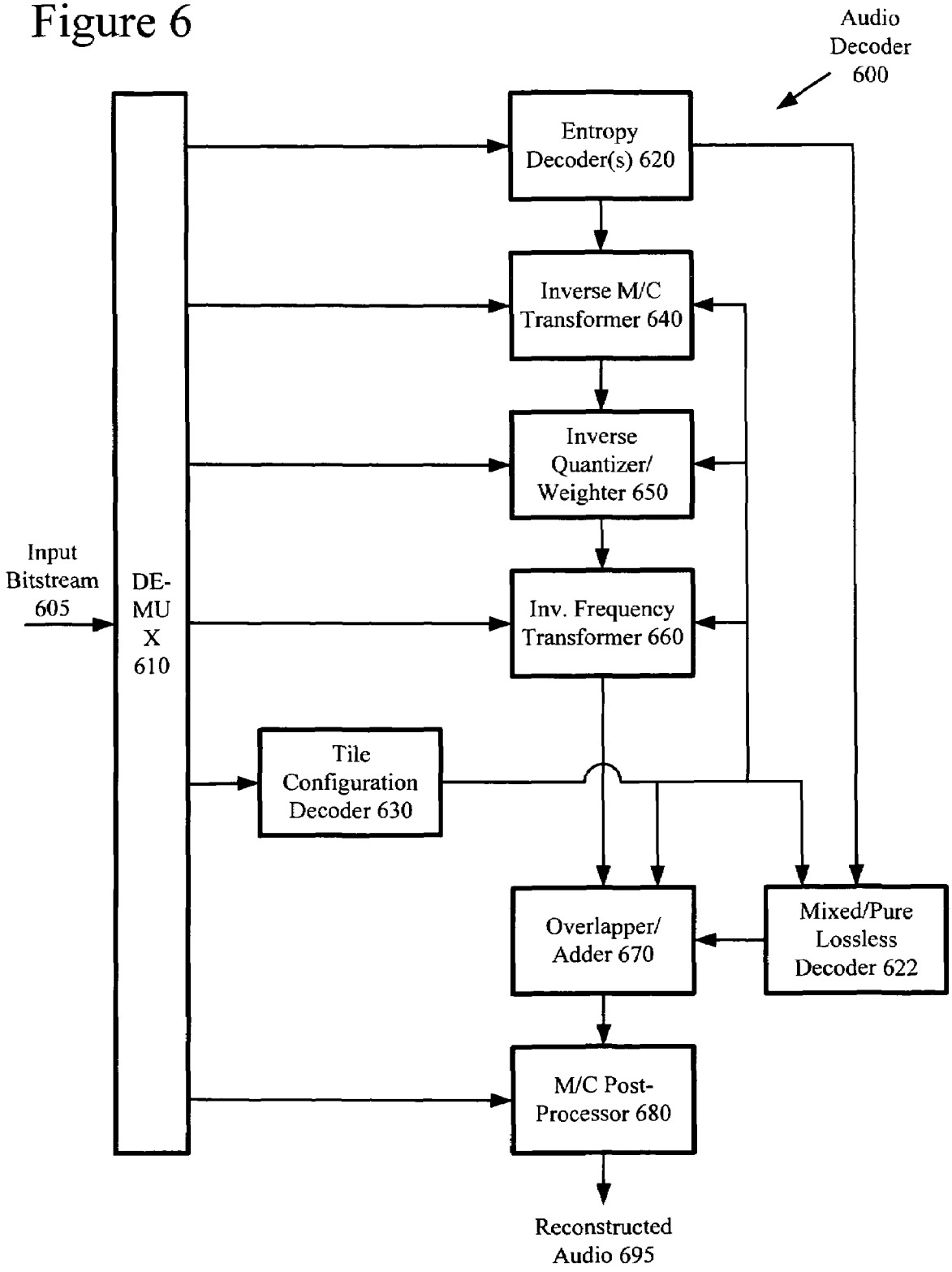
FIG. 6 is a block diagram of a corresponding audio decoder.

FIG. 4 shows a generalized audio encoder for one-pass encoding, in conjunction with which a two-pass VBR control strategy may be implemented. FIG. 5 shows a particular audio encoder for one-pass encoding, in conjunction with which the two-pass VBR control strategy may be implemented. FIG. 6 shows a corresponding audio decoder.

The relationships shown between modules within the encoders and decoder indicate the main flow of information in the encoders and decoder; other relationships are not shown for the sake of simplicity. Depending on implementation and the type of compression desired, modules of the encoders or decoder can be added, omitted, split into multiple modules, combined with other modules, and/or replaced with like modules. In alternative embodiments, an encoder with different modules and/or other configurations of modules controls quality and bitrate of compressed audio information.

A. Generalized Encoder

FIG. 4 is an abstraction of the encoder of FIG. 5 and encoders with other architectures and/or components. The generalized encoder (400) includes a transformer (410), a quality reducer (430), a lossless coder (450), and a controller (470).

The transformer (410) receives input data (405) and performs one or more transforms on the input data (405). The transforms may include prediction, time slicing, channel transforms, frequency transforms, or time-frequency tile generating subband transforms, linear or non-linear transforms, or any combination thereof.

The quality reducer (430) works in the transformed domain and reduces quality (i.e., introduces distortion) so as to reduce the output bitrate. By reducing quality carefully, the quality reducer (430) can lessen the perceptibility of the introduced distortion. A quantizer (scalar, vector, or other) is an example of a quality reducer (430). In many predictive coding schemes, the quality reducer (430) provides feedback to the transformer (410).

The lossless coder (450) is typically an entropy encoder that takes quantized indices as inputs and entropy codes the data for the final output bitstream.

The controller (470) determines the data transform to perform, output quality, and/or the entropy coding to perform, so as to meet constraints on the bitstream. The constraints may be on quality of the output, the bitrate of the output, latency in the system, overall file size, peak bitrate, and/or other criteria.

Figure 1:
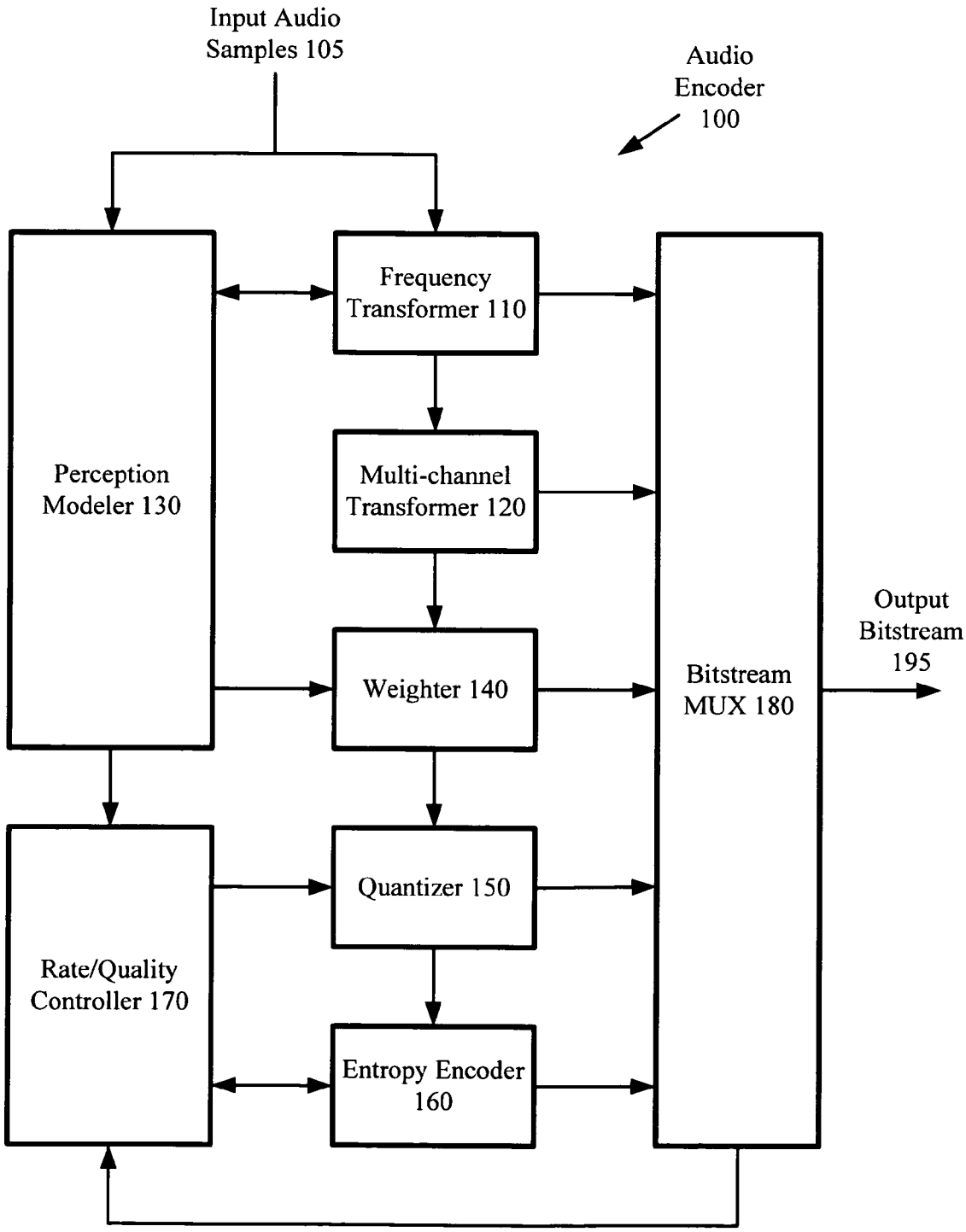
FIG. 1 is a block diagram of an audio encoder for one-pass encoding according to the prior art.
Figure 2:
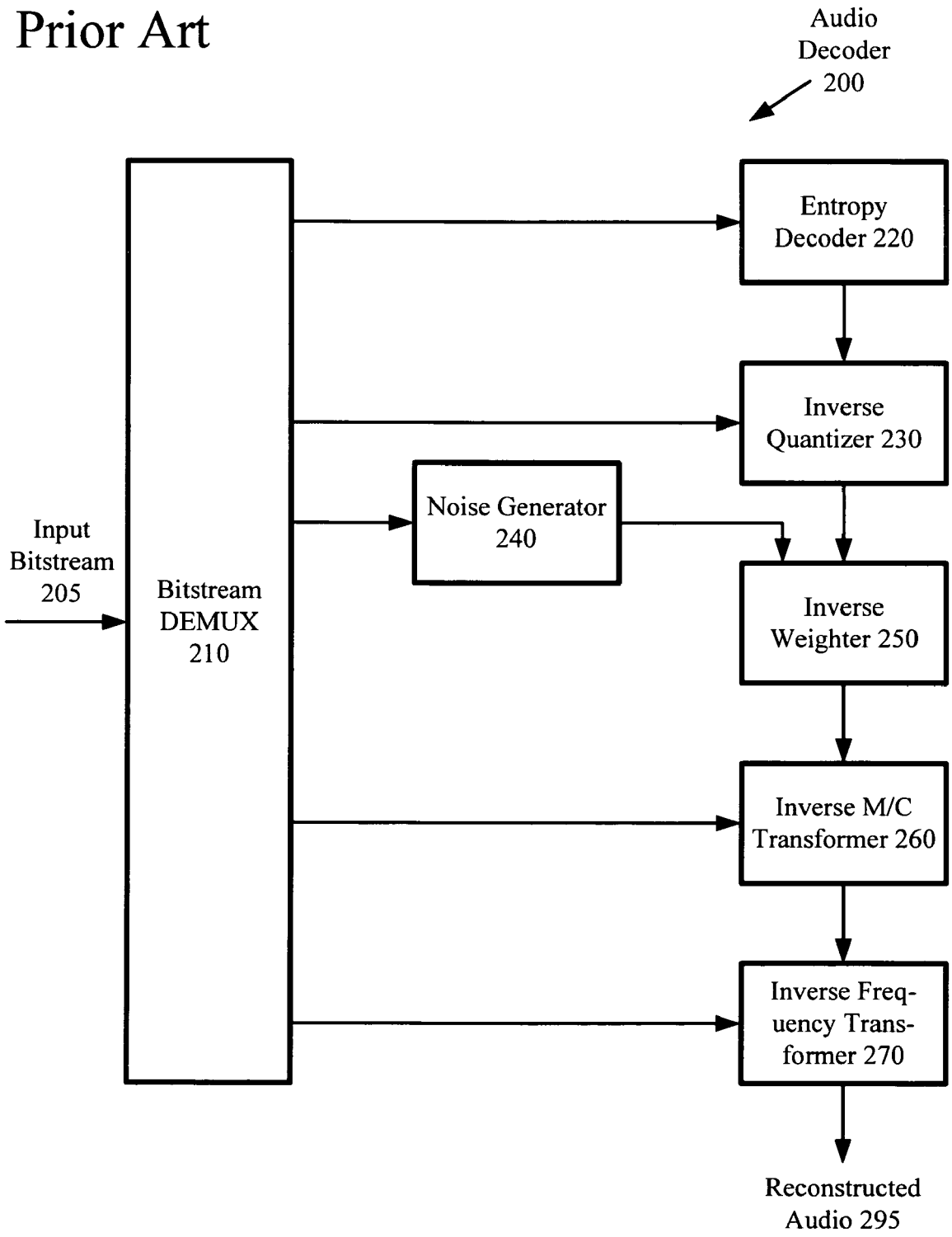
FIG. 2 is a block diagram of an audio decoder according to the prior art.

When used in conjunction with the control strategies described herein, the encoder (400) may take the form of a traditional, transform-based audio encoder such as the one shown in FIG. 1, an audio encoder having the architecture shown in FIG. 5, or another encoder.

B. Detailed Audio Encoder

With reference to FIG. 5, the audio encoder (500) includes a selector (508), a multichannel pre-processor (510), a partitioner/tile configurer (520), a frequency transformer (530), a perception modeler (540), a weighter (542), a multi-channel transformer (550), a quantizer (560), an entropy encoder (570), a controller (580), a mixed/pure lossless coder (572) and associated entropy encoder (574), and a bitstream multiplexer ["MUX"] (590).

The encoder (500) receives a time series of input audio samples (505) at some sampling depth and rate in pulse code modulated ["PCM"] format. The input audio samples (505) are for multi-channel audio (e.g., stereo, surround) or for mono audio. The encoder (500) compresses the audio samples (505) and multiplexes information produced by the various modules of the encoder (500) to output a bitstream (595) in a format such as a WMA format or Advanced Streaming Format ["ASF"]. Alternatively, the encoder (500) works with other input and/or output formats.

The selector (508) selects between multiple encoding modes for the audio samples (505). In FIG. 5, the selector (508) switches between a mixed/pure lossless coding mode and a lossy coding mode. The lossless coding mode includes the mixed/pure lossless coder (572) and is typically used for high quality (and high bitrate) compression. The lossy coding mode includes components such as the weighter (542) and quantizer (560) and is typically used for adjustable quality (and controlled bitrate) compression. The selection decision at the selector (508) depends upon user input or other criteria. In certain circumstances (e.g., when lossy compression fails to deliver adequate quality or overproduces bits), the encoder (500) may switch from lossy coding over to mixed/pure lossless coding for a frame or set of frames.

For lossy coding of multi-channel audio data, the multi-channel pre-processor (510) optionally re-matrixes the time-domain audio samples (505). In some embodiments, the multi-channel pre-processor (510) selectively re-matrixes the audio samples (505) to drop one or more coded channels or increase inter-channel correlation in the encoder (500), yet allow reconstruction (in some form) in the decoder (600). This gives the encoder additional control over quality at the channel level. The multi-channel pre-processor (510) may send side information such as instructions for multi-channel post-processing to the MUX (590). Alternatively, the encoder (500) performs another form of multi-channel pre-processing.

The partitioner/tile configurer (520) partitions a frame of audio input samples (505) into sub-frame blocks (i.e., windows) with time-varying size and window shaping functions. The sizes and windows for the sub-frame blocks depend upon detection of transient signals in the frame, coding mode, as well as other factors.

If the encoder (500) switches from lossy coding to mixed/pure lossless coding, sub-frame blocks need not overlap or have a windowing function in theory (i.e., non-overlapping, rectangular-window blocks), but transitions between lossy coded frames and other frames may require special treatment. The partitioner/tile configurer (520) outputs blocks of partitioned data to the mixed/pure lossless coder (572) and outputs side information such as block sizes to the MUX (590).

When the encoder (500) uses lossy coding, variable-size windows allow variable temporal resolution. Small blocks allow for greater preservation of time detail at short but active transition segments. Large blocks have better frequency resolution and worse time resolution, and usually allow for greater compression efficiency at longer and less active segments, in part because frame header and side information is proportionally less than in small blocks, and in part because it allows for better redundancy removal. Blocks can overlap to reduce perceptible discontinuities between blocks that could otherwise be introduced by later quantization. The partitioner/tile configurer (520) outputs blocks of partitioned data to the frequency transformer (530) and outputs side information such as block sizes to the MUX (590). Alternatively, the partitioner/tile configurer (520) uses other partitioning criteria or block sizes when partitioning a frame into windows.

In some embodiments, the partitioner/tile configurer (520) partitions frames of multi-channel audio on a per-channel basis. The partitioner/tile configurer (520) independently partitions each channel in the frame, if quality/bitrate allows. This allows, for example, the partitioner/tile configurer (520) to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the partitioner/tile configurer (520), groups windows of the same size that are co-located in time as a tile.

The frequency transformer (530) receives audio samples and converts them into data in the frequency domain. The frequency transformer (530) outputs blocks of frequency coefficient data to the weighter (542) and outputs side information such as block sizes to the MUX (590). The frequency transformer (530) outputs both the frequency coefficients and the side information to the perception modeler (540). In some embodiments, the frequency transformer (530) applies a time-varying Modulated Lapped Transform ["MLT"] MLT to the sub-frame blocks, which operates like a DCT modulated by the sine window function(s) of the sub-frame blocks. Alternative embodiments use other varieties of MLT, or a DCT or other type of modulated or non-modulated, overlapped or non-overlapped frequency transform, or use subband or wavelet coding.

The perception modeler (540) models properties of the human auditory system to improve the perceived quality of the reconstructed audio signal for a given bitrate. Generally, the perception modeler (540) processes the audio data according to an auditory model, then provides information to the weighter (542) which can be used to generate weighting factors for the audio data. The perception modeler (540) uses any of various auditory models and passes excitation pattern information or other information to the weighter (542).

The quantization band weighter (542) generates weighting factors for quantization matrices based upon the information received from the perception modeler (540) and applies the weighting factors to the data received from the frequency transformer (530). The weighting factors for a quantization matrix include a weight for each of multiple quantization bands in the audio data. The quantization bands can be the same or different in number or position from the critical bands used elsewhere in the encoder (500), and the weighting factors can vary in amplitudes and number of quantization bands from block to block. The quantization band weighter (542) outputs weighted blocks of coefficient data to the channel weighter (543) and outputs side information such as the set of weighting factors to the MUX (590). The set of weighting factors can be compressed for more efficient representation. If the weighting factors are lossy compressed, the reconstructed weighting factors are typically used to weight the blocks of coefficient data. Alternatively, the encoder (500) uses another form of weighting or skips weighting.

The channel weighter (543) generates channel-specific weight factors (which are scalars) for channels based on the information received from the perception modeler (540) and also on the quality of locally reconstructed signal. The scalar weights (also called quantization step modifiers) allow the encoder (500) to give the reconstructed channels approximately uniform quality. The channel weight factors can vary in amplitudes from channel to channel and block to block, or at some other level. The channel weighter (543) outputs weighted blocks of coefficient data to the multi-channel transformer (550) and outputs side information such as the set of channel weight factors to the MUX (590). The channel weighter (543) and quantization band weighter (542) in the flow diagram can be swapped or combined together. Alternatively, the encoder (500) uses another form of weighting or skips weighting.

For multi-channel audio data, the multiple channels of noise-shaped frequency coefficient data produced by the channel weighter (543) often correlate, so the multi-channel transformer (550) may apply a multi-channel transform. For example, the multi-channel transformer (550) selectively and flexibly applies the multi-channel transform to some but not all of the channels and/or quantization bands in the tile. This gives the multi-channel transformer (550) more precise control over application of the transform to relatively correlated parts of the tile. To reduce computational complexity, the multi-channel transformer (550) may use a hierarchical transform rather than a one-level transform. To reduce the bitrate associated with the transform matrix, the multi-channel transformer (550) selectively uses pre-defined matrices (e.g., identity/no transform, Hadamard, DCT Type II) or custom matrices, and applies efficient compression to the custom matrices. Finally, since the multi-channel transform is downstream from the weighter (542), the perceptibility of noise (e.g., due to subsequent quantization) that leaks between channels after the inverse multi-channel transform in the decoder (600) is controlled by inverse weighting. Alternatively, the encoder (500) uses other forms of multi-channel transforms or no transforms at all. The multi-channel transformer (550) produces side information to the MUX (590) indicating, for example, the multi-channel transforms used and multi-channel transformed parts of tiles.

The quantizer (560) quantizes the output of the multi-channel transformer (550), producing quantized coefficient data to the entropy encoder (570) and side information including quantization step sizes to the MUX (590). In FIG. 5, the quantizer (560) is an adaptive, uniform, scalar quantizer that computes a quantization factor per tile. The tile quantization factor can change from one iteration of a quantization loop to the next to affect the bitrate of the entropy encoder (560) output, and the per-channel quantization step modifiers can be used to balance reconstruction quality between channels. In alternative embodiments, the quantizer is a non-uniform quantizer, a vector quantizer, and/or a non-adaptive quantizer, or uses a different form of adaptive, uniform, scalar quantization. In other alternative embodiments, the quantizer (560), quantization band weighter (542), channel weighter (543), and multi-channel transformer (550) are fused and the fused module determines various weights all at once.

The entropy encoder (570) losslessly compresses quantized coefficient data received from the quantizer (560). In some embodiments, the entropy encoder (570) uses adaptive entropy encoding that switches between level and run length/level modes Alternatively, the entropy encoder (570) uses some other form or combination of multi-level run length coding, variable-to-variable length coding, run length coding, Huffman coding, dictionary coding, arithmetic coding, LZ coding, or some other entropy encoding technique. The entropy encoder (570) can compute the number of bits spent encoding audio information and pass this information to the rate/quality controller (580).

The controller (580) works with the quantizer (560) to regulate the bitrate and/or quality of the output of the encoder (500). The controller (580) receives information from other modules of the encoder (500) and processes the received information to determine desired quantization factors given current conditions. The controller (570) outputs the quantization factors to the quantizer (560) with the goal of satisfying quality and/or bitrate constraints. When the encoder is used in conjunction with a two-pass VBR control strategy, the controller (580) controls encoding in the first pass and records statistics describing the results of the encoding, processes the statistics, and controls encoding in the second pass.

The mixed/pure lossless encoder (572) and associated entropy encoder (574) compress audio data for the mixed/pure lossless coding mode. The encoder (500) uses the mixed/pure lossless coding mode for an entire sequence or switches between coding modes on a frame-by-frame, block-by-block, tile-by-tile, or other basis. Alternatively, the encoder (500) uses other techniques for mixed and/or pure lossless encoding.

The MUX (590) multiplexes the side information received from the other modules of the audio encoder (500) along with the entropy encoded data received from the entropy encoders (570, 574). The MUX (590) outputs the information in a WMA format or another format that an audio decoder recognizes. The MUX (590) may include a virtual buffer that stores the bitstream (595) to be output by the encoder (500). The current fullness and other characteristics of the buffer can be used by the controller (580) to regulate quality and/or bitrate.

C. Detailed Audio Decoder

With reference to FIG. 6, a corresponding audio decoder (600) includes a bitstream demultiplexer ["DEMUX"] (610), one or more entropy decoders (620), a mixed/pure lossless decoder (622), a tile configuration decoder (630), an inverse multi-channel transformer (640), a inverse quantizer/weighter (650), an inverse frequency transformer (660), an overlapper/adder (670), and a multi-channel post-processor (680). The decoder (600) is somewhat simpler than the encoder (600) because the decoder (600) does not include modules for rate/quality control or perception modeling.

The decoder (600) receives a bitstream (605) of compressed audio information in a WMA format or another format. The bitstream (605) includes entropy encoded data as well as side information from which the decoder (600) reconstructs audio samples (695).

The DEMUX (610) parses information in the bitstream (605) and sends information to the modules of the decoder (600). The DEMUX (610) includes one or more buffers to compensate for variations in bitrate due to fluctuations in complexity of the audio, network jitter, and/or other factors.

The one or more entropy decoders (620) losslessly decompress entropy codes received from the DEMUX (610). The entropy decoder (620) typically applies the inverse of the entropy encoding technique used in the encoder (500). For the sake of simplicity, one entropy decoder module is shown in FIG. 6, although different entropy decoders may be used for lossy and lossless coding modes, or even within modes. Also, for the sake of simplicity, FIG. 6 does not show mode selection logic. When decoding data compressed in lossy coding mode, the entropy decoder (620) produces quantized frequency coefficient data.

The mixed/pure lossless decoder (622) and associated entropy decoder(s) (620) decompress losslessly encoded audio data for the mixed/pure lossless coding mode. Alternatively, decoder (600) uses other techniques for mixed and/or pure lossless decoding.

The tile configuration decoder (630) receives and, if necessary, decodes information indicating the patterns of tiles for frames from the DEMUX (690). The tile pattern information may be entropy encoded or otherwise parameterized. The tile configuration decoder (630) then passes tile pattern information to various other modules of the decoder (600). Alternatively, the decoder (600) uses other techniques to parameterize window patterns in frames.

The inverse multi-channel transformer (640) receives the quantized frequency coefficient data from the entropy decoder (620) as well as tile pattern information from the tile configuration decoder (630) and side information from the DEMUX (610) indicating, for example, the multi-channel transform used and transformed parts of tiles. Using this information, the inverse multi-channel transformer (640) decompresses the transform matrix as necessary, and selectively and flexibly applies one or more inverse multi-channel transforms to the audio data. The placement of the inverse multi-channel transformer (640) relative to the inverse quantizer/weighter (640) helps shape quantization noise that may leak across channels.

The inverse quantizer/weighter (650) receives tile and channel quantization factors as well as quantization matrices from the DEMUX (610) and receives quantized frequency coefficient data from the inverse multi-channel transformer (640). The inverse quantizer/weighter (650) decompresses the received quantization factor/matrix information as necessary, then performs the inverse quantization and weighting. In alternative embodiments, the inverse quantizer/weighter applies the inverse of some other quantization techniques used in the encoder.

The inverse frequency transformer (660) receives the frequency coefficient data output by the inverse quantizer/weighter (650) as well as side information from the DEMUX (610) and tile pattern information from the tile configuration decoder (630). The inverse frequency transformer (670) applies the inverse of the frequency transform used in the encoder and outputs blocks to the overlapper/adder (670).

In addition to receiving tile pattern information from the tile configuration decoder (630), the overlapper/adder (670) receives decoded information from the inverse frequency transformer (660) and/or mixed/pure lossless decoder (622). The overlapper/adder (670) overlaps and adds audio data as necessary and interleaves frames or other sequences of audio data encoded with different modes. Alternatively, the decoder (600) uses other techniques for overlapping, adding, and interleaving frames.

The multi-channel post-processor (680) optionally re-matrixes the time-domain audio samples output by the overlapper/adder (670). The multi-channel post-processor selectively re-matrixes audio data to create phantom channels for playback, perform special effects such as spatial rotation of channels among speakers, fold down channels for playback on fewer speakers, or for any other purpose. For bitstream-controlled post-processing, the post-processing transform matrices vary over time and are signaled or included in the bitstream (605). Alternatively, the decoder (600) performs another form of multi-channel post-processing.

III. Two-Pass VBR Control Strategy

An audio encoder uses two-pass encoding to produce compressed audio information with relatively constant quality but variable bitrate, while also satisfying a constraint on the overall size of the compressed bitstream. This allows the encoder to provide relatively uniform quality in coded audio data for a given overall size.

In a two-pass encoding scheme, an encoder analyzes input during a first pass to estimate the complexity of the entire input, and then decides a strategy for compression. During a second pass, the encoder applies this strategy to generate the actual bitstream.

In general, the process details of a control strategy (whether in a one-pass, two-pass, or delayed-decision solution) depend on the constraints placed on the output. In particular, if the generated bitstream is to be streamed over CBR channels, the encoder places CBR constraints on the output. When a CBR constraint is placed on encoding, the quality of the output can vary wildly over time. This may be objectionable to a user who is mainly concerned with the final size of the compressed data (e.g., for archiving and local storage) and the quality of playback. So, in such cases, the encoder follows a constant quality constraint. Under the constant quality constraint, the goal of the encoder is to keep the quality of the coded representation of the input at or near a target quality for the duration of the clip. The quality metric is the quantizer step size used, PSNR obtained, mean squared error, noise to mask ratio ("NMR"), NER, or some other measure.

A constant target quality constraint can result in uncertain size for the compressed results. To address this additional concern, the encoder considers an overall compressed data size constraint. At the same time, the encoder may consider a peak bitrate constraint to limit the maximum bitrate for the compressed data, thereby satisfying rate limitations of particular devices. The encoder may consider further constraints related to minimum allowable quality or other criteria.

Figure 7:
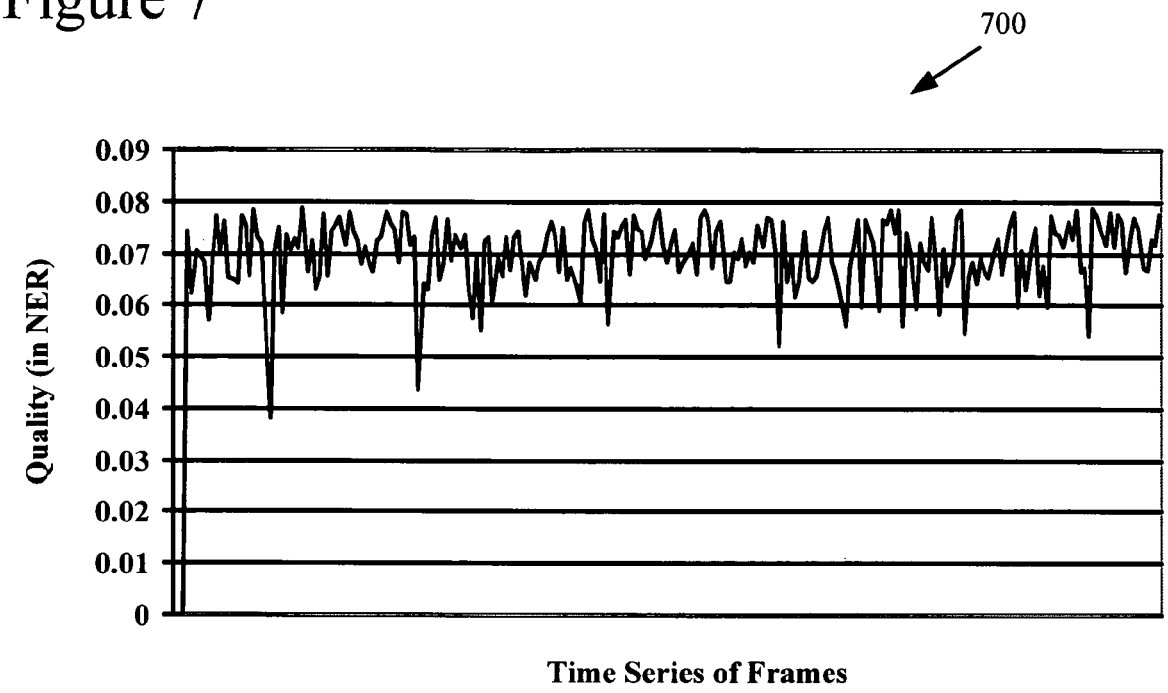
FIG. 7 is a graph of quality over time according to a VBR control strategy.

When an encoder uses a target quality constraint, the actual quality obtained is not a constant, but may vary slightly over time, as shown in FIG. 7. FIG. 7 shows a graph (700) of quality versus time for a sequence of encoded audio data. The horizontal axis represents a time series of frames, and the vertical axis represents a range of NER values for the frames. The NER value 0.07 roughly corresponds to good quality for content of typical complexity at 64 Kb/s, while the NER value of 0.01 roughly corresponds to output that is nearly perceptually indistinguishable from the original.

Figure 8:
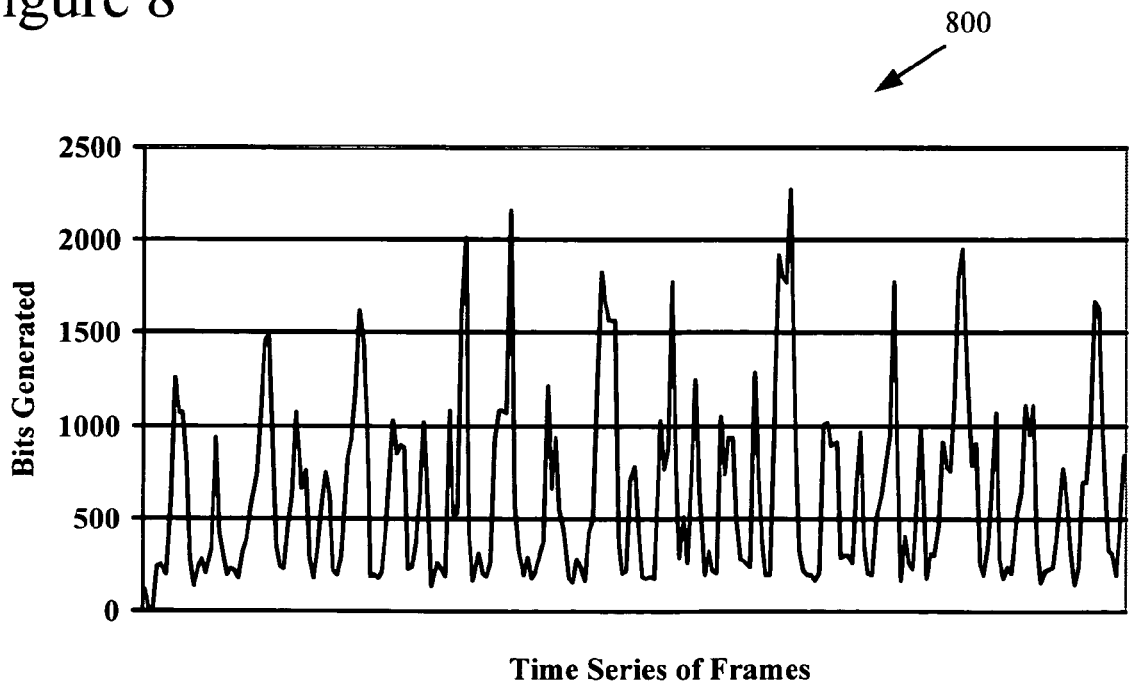
FIG. 8 is a graph of bits produced over time according to a VBR control strategy.

In comparison, the number of bits generated for the same sequence may vary greatly over time, as shown in FIG. 8. FIG. 8 is a graph (800) of bits produced versus time for the sequence. The horizontal axis again represents the time series of frames, and the vertical axis represents the count of bits generated per frame. The variation in bits produced relates mainly to the complexity of the input, which can be quite erratic over time, depending on the genre (for music), composition, editing, etc.

Due to differences in complexity for different sequences, if a particular time-limited sequence of audio content is coded at constant quality, the overall size of the compressed representation can be unpredictable. This can lead to uncertainty and inconvenience for the user, as storage for the compressed data cannot be pre-determined for the input. So, as an additional target, the encoder uses a target overall size for the compressed data. The target size for a sequence of audio data can be reached with a number of possible encodings of the audio data. One reasonable consideration is to concurrently strive for constant quality of the output. Even with the dual constraints of a target overall size and target quality, coding complexity of the audio data can vary from one input to another, lead to variation of quality from output to output.

Figure 9:
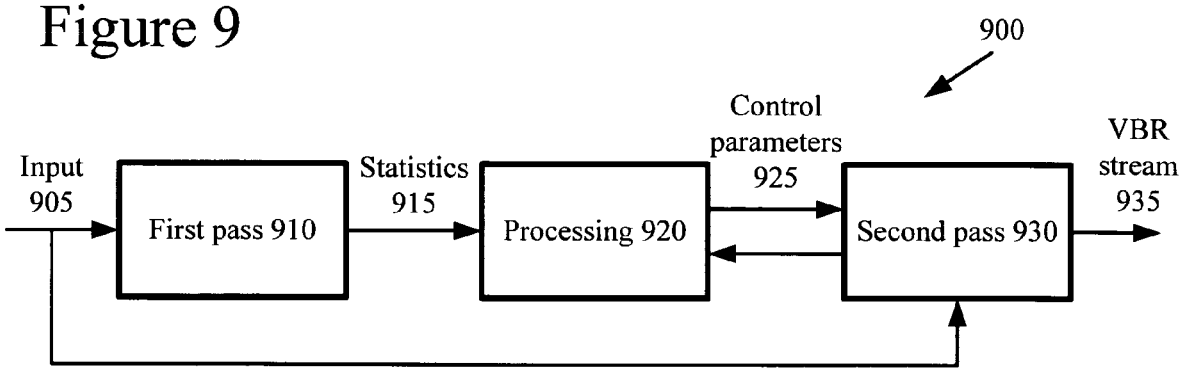
FIG. 9 is a flowchart of a two-pass VBR control strategy.

FIG. 9 shows a two-pass VBR control strategy (900) that jointly considers the constraints of target quality and target overall size. The strategy can be realized in conjunction with a one-pass audio encoder such as the one-pass encoder (500) of FIG. 5, the one-pass encoder (100) of FIG. 1, or another implementation of the encoder (400) of FIG. 4. No special decoder is needed for decoding VBR streams; the same decoder that handles CBR streams is able to handle VBR streams. This is the case with the encoder/decoder pairs shown in FIGS. 1/2 and 5/6.

Like the other flowcharts described herein, FIG. 9 shows the main flow of information; other relationships are not shown for the sake of simplicity. Depending on implementation, stages can be added, omitted, split into multiple stages, combined with other stages, and/or replaced with like stages. In alternative embodiments, an encoder uses a strategy with different stages and/or other configurations of stages to control quality and/or bitrate.

Several stages of the strategy (900) compute or use a quality measure for a block that indicates the quality for the block. The quality measure is typically expressed in terms of NER. Actual NER values may be computed from noise patterns and excitation patterns for blocks, or suitable NER values for blocks may be estimated based upon complexity, bitrate, and other factors. For additional detail about NER and NER computation, see U.S. patent application Ser. No. 10/017,861, filed Dec. 14, 2001, entitled "Techniques for Measurement of Perceptual Audio Quality," published on Jun. 19, 2003, as Publication No. US-2003-0115042-A1, the disclosure of which is hereby incorporated by reference. More generally, stages of the strategy (900) compute quality measures based upon available information, and can use measures other than NER for objective or perceptual quality.

Returning to FIG. 9, in a first pass (910), the encoder gathers statistics regarding the coding complexity of the input (905). For example, the encoder encodes the input (905) at different quantization step sizes and stores statistics (915) relating to quality and bitrate for the different quantization step sizes.

The encoder then processes (920) the statistics (915), deriving one or more control parameters (925) such as a target quality level for the sequence in view of the collective complexity of the input (905). Alternatively, the encoder computes other and/or additional control parameters. The encoder uses the control parameters (925) to control encoding in the second pass (930).

In the second pass (930), using the control parameters (925) and complexity information, the encoder distributes the available bits over different segments of the input (905) such that approximately constant quality of representation is obtained in a VBR output bitstream (935). The encoder may use intermediate results of encoding in the second pass (930) to adjust the processing (920), adaptively changing the control parameters (925). Also, the encoder may place additional constraints, such as peak bitrate, on the encoding.

A. First Pass

In the first pass, the encoder gathers statistics on the complexity of coding each chunk of the input. A chunk is a block of input such as a frame, sub-frame, or tile. Chunks can have different sizes, and all chunks need not have the same size in a sequence of audio data. (This is in contrast with typical video coding applications, where frames are regularly spaced and have constant size.)

Figure 10:
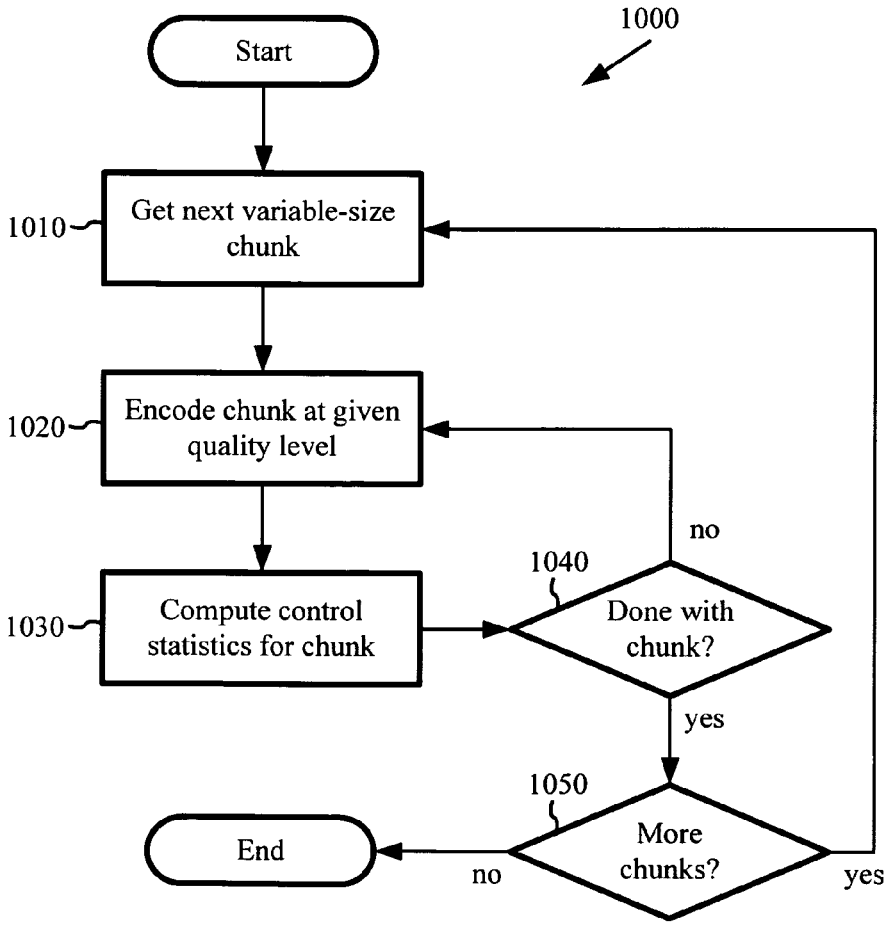
FIG. 10 is a flowchart showing a technique for gathering statistics for an audio sequence with variable-size chunks in a first pass.

FIG. 10 shows a technique (1000) for gathering statistics for a sequence of audio with variable-size chunks in the first pass. An encoder first gets (1010) the next variable-size chunk in the sequence. For example, the chunk is a tile of multichannel audio data in an audio sequence.

Next, the encoder encodes (1020) the variable-size chunk at a given quality level/quantization step size. The encoder processes the input data for the chunk using the normal components and techniques for the encoder. For example, the encoder (500) of FIG. 5 performs transient detection, determines tile configurations, determines playback durations for tiles, decides channel transforms, determines channel masks, etc.

The encoder stores auxiliary information, which is side information resulting from analysis of the audio data by the encoder. The auxiliary information generally includes frame partitioning information, perceptual weight values, and channel transform information. For example, the encoder (500) of FIG. 5 stores tile configurations, channel transforms, and mask values from the first pass. The encoder will use the stored information in the second pass to speed up encoding in the second pass. Alternatively, the encoder discards auxiliary information and re-computes it in the second pass.

During the first pass, the encoder computes (1030) control statistics for the variable-size chunk encoded at the given quality level. Specifically, for each chunk, the encoded gathers statistics on complexity, quality, and bitrate. To do this, the encoder partially codes the input chunks at different quality levels and notes the number of bits produced. In one implementation, the encoder records a triplet (Step, Bits, Quality) consisting of the quantizer step size, number of bits produced with that step size, and the measured quality in terms of NER. Alternatively, the encoder computes other and/or additional statistics, for example, using a different quality metric.

The encoder determines (1040) whether the encoder is done with the chunk. If the step-rate-distortion curve for the input chunk is well behaved, statistics at one or two quality levels per input chunk would be sufficient to describe the step-rate-distortion curve. (This is typically the case for video inputs.) Unfortunately, the step-rate-distortion performance of any given chunk of audio data can be quite erratic, in part due to the non-linear nature of quality metrics such as NER. Thus, the encoder usually computes and stores more statistics per chunk to facilitate meaningful prediction from the triplets. The encoder attempts to record statistics with a few useful quality levels.

In one implementation, the encoder computes and records a triplet at an initial target NER (which is derived from a heuristic based on average requested bitrate). The encoder continues computing and recording triplets until data points are found for the endpoints of a useful range of quality measures—a range likely to be used in the second pass encoding. For example, the encoder continues until it finds a data point close to NER of 0.02 and another data point close to NER of 0.08. For a different target range, the encoder would seek different endpoints. The encoder computes up to 35 triplets per chunk, if the encoder is unable to stop sooner.

If the encoder is done with the chunk, the encoder determines (1050) whether there are any more variable-size chunks in the sequence. If so, the encoder gets (1010) the next variable-size chunk and continues. Otherwise, the technique (1000) ends.

Alternatively, the encoder performs the first pass on an input source with fixed size chunks. Moreover, instead of encoding the chunks at multiple quality levels in one pass through the input, the encoder may encode the chunks in multiple passes, with one quality level per pass, as part of the "first pass."

B. Processing Statistics

In the processing stage, the encoder determines how to spread the available bits between the chunks of audio data to represent the input in the second pass, given the computed statistics (e.g., step-rate-distortion triplets) for the chunks from the first pass. Specifically, the encoder attempts to spread the available bits such that the resulting quality is uniform over time, subject to the overall size constraint and any additional constraints (such as peak bitrate limit) that concurrently apply. The processing stage and second pass may occur in a feedback loop, with the processing stage being called from different places in the second pass, such that the processing stage influences and is influenced by the results of encoding in the second stage.

The processing stage includes several sub-stages used in different combinations at different times before and during the second pass. Overall, the encoder predicts the number of bits generated by coding forthcoming input chunks at a particular quality. Based on the prediction, the encoder determines the quality at which to code the input to satisfy the overall size and other constraints, producing one or more control parameters such as target quality.

The encoder predicts bits produced at a particular target quality in two steps. First, the encoder estimates the quantizer step size needed to arrive at the target quality. Then, the encoder estimates the number of bits that would be produced with that quantizer step size. The encoder performs the prediction for each chunk (e.g., tile). Alternatively, the encoder predicts the bits produced at a particular target quality in a single stage (i.e., predicting bits produced directly from quality) and/or predicts bits for a different size segment of audio data. The encoder can store a quantization step size to use in the second pass in order to achieve a particular quality, thereby speeding up the encoding in the second pass.

If a peak bitrate constraint applies, the encoder tests the peak bitrate constraint. The encoder maintains a model of a decoder buffer to verify that the peak bitrate is not exceeded.

The encoder estimates a target quality for a given number of bits for a series of chunks, iteratively using the previous sub-stages. The encoder may also compute checkpoints at which control parameters are adjusted to account for inaccuracies in estimation.

1. Estimating the Quantization Step Size for a Target Quality

In the two-stage prediction, the encoder first estimates the quantizer step size needed to arrive at the target quality. The estimation used depends on the form of the computed statistics as well as the model relating quantization step size to quality.

In one implementation, given a target quality $\text{Quality}_{Target}$, the encoder goes through the list of triplets (Step, Bits, Quality) and identifies the nearest smaller step size $\text{Step}_L$ that produces equal or slightly better quality $\text{Quality}_L$ than the target quality $\text{Quality}_{Target}$. The encoder also identifies the nearest larger step size $\text{Step}_R$ that produces equal or slightly worse quality $\text{Quality}_R$ than the target quality $\text{Quality}_{Target}$. If either $\text{Quality}_L$ or $\text{Quality}_R$ is sufficiently close to the target quality $\text{Quality}_{Target}$, the encoder uses the corresponding step size $\text{Step}_L$ or $\text{Step}_R$.

Otherwise, the encoder performs an interpolation to estimate the step size $\text{EstStep}_{Target}$ needed to produce the target quality. In the interpolation, the encoder assumes a relation between the step size and quality.

$$\text{Quality}=F(\text{Step}) \quad (4),$$

where F( ) is an implementation dependent function. F( ) may depend on the input and also on the local characteristics of the step-rate-distortion curves. As such, F( ) may change from chunk to chunk. Depending on the function used, a number of actual data points are used for the variables in the function. In one function, the encoder uses two data points and a measure of log-log linearity for F( ) in the interpolation, solving for log of estimated target quantization step size:

$$\log(EstStep_{Target}) = \log(Step_L) + (\log(Step_R) - \log(Step_L)) \cdot \frac{(\log(Quality_{Target}) - \log(Quality_L))}{(\log(Quality_R) - \log(Quality_L))}. \quad (5)$$

The encoder then computes the estimated target quantization step size:

$$\text{EstStep}_{Target}=\text{Round}(e^{\log(EstStepTarget)}) \quad (6).$$

The encoder also performs checks to prevent operations such as divide by zero, log of zero, and log of negative values.

Alternatively, the encoder uses a different technique and/or relies on different statistics to estimate the quantizer step size needed to arrive at the target quality.

2. Estimating the Bits Produced for a Quantization Step Size

In the two-stage prediction, the encoder then estimates the number of bits that would be produced with the estimated quantization step size. The estimation used depends on the form of the computed statistics as well as the model relating bits produced to quantization step size.

In one implementation, given a target step size $\text{EstStep}_{Target}$, the encoder goes through the list of triplets (Step, Bits, Quality) and identifies the nearest smaller step size $\text{Step}_L$ that is equal or slightly smaller than the target step size $EstStep_{Target}$. The encoder also identifies the nearest larger step size $Step_R$ that is equal or slightly larger than the target step size $EstStep_{Target}$. If either $Step_L$ or $Step_R$ is sufficiently close to the target step size $EstStep_{Target}$, the encoder uses the corresponding bits $Bits_L$ or $Bits_R$ in its prediction.

Otherwise, the encoder performs an interpolation to estimate the number of bits produced with the target step size. In the interpolation, the encoder assumes a log-linear relation between step size and bits, which can be generalized as:

$$Bits=\alpha\cdot\beta^{Step} \quad (7),$$

where $\alpha$ and $\beta$ are constants that depend on the content as well as the region of operation in the step-rate-distortion curve, and where equation (7) may be rewritten as:

$$\log(Bits)=\log(\alpha)+Step\cdot\log(\beta) \quad (8).$$

For one function, equation (8) in turn is written for target, left, and right points, eliminating $\alpha$ and $\beta$, for interpolation according to the following relation:

$$\log(Bits_{Target}) = \log(Bits_L) + (\log(Bits_R) - \log(Bits_L))\cdot\frac{(Step_{Target} - Step_L)}{(Step_R - Step_L)}. \quad (9)$$

The encoder then computes the estimated bits produced:

$$Bits_{Target}=Round(e^{\log(Bit_{Target})}) \quad (10).$$

Again, the encoder performs checks to prevent operations such as divide by zero, log of zero, and log of negative values.

Alternatively, the encoder uses a different technique and/or relies on different statistics to estimate the bits produced from an estimated quantization step size.

3. Buffer Model to Verify Peak Bitrate Constraint

The encoder in the two-pass VBR control strategy may also consider a constraint on peak bitrate. The peak bitrate constraint signifies, for example, the maximum rate at which a particular device can transmit or accept encoded audio data. The encoder satisfies the peak bitrate constraint so that such a device is not expected to transmit or receive audio data at an excessive rate.

Figure 11:
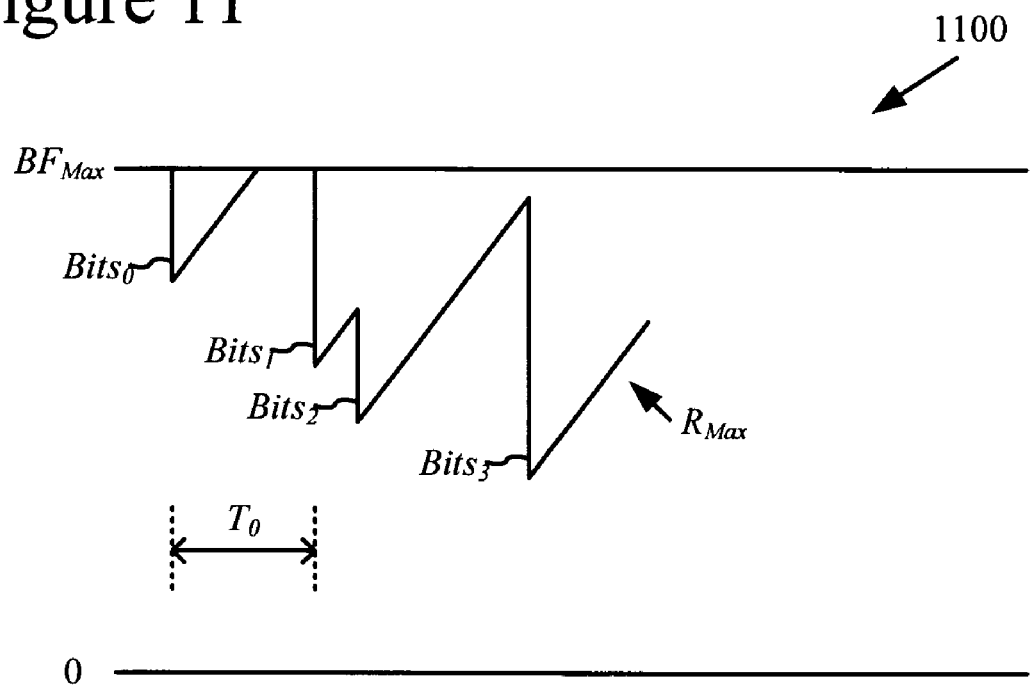
FIG. 11 is a chart showing a model of a hypothetical decoder buffer for checking a peak bitrate constraint.

In one implementation, a model for VBR encoding includes a hypothetical decoder buffer of size $BF_{Max}$ that can be filled at a maximum rate of $R_{Max}$ bits/second. FIG. 11 shows a model (1100) of such a hypothetical decoder buffer. The encoder assumes that the buffer is full at the beginning. According to the model, a decoder draws compressed bits from the buffer for a chunk (e.g., $Bits_0$ for chunk 0, $Bits_1$ for chunk 1, etc.), decodes, and presents the decoded samples. The act of drawing compressed bits is assumed to be instantaneous. Whenever there is room in the decoder buffer, compressed bits are added to the buffer at the rate of $R_{Max}$. If the buffer is full, it is not over-filled.

In peak-constrained VBR encoding, the constraint on encoding is that the decoder should not starve; that is, the decoder buffer should not underflow. In an underflow situation, the decoder needs to draw bits from the buffer, but the bits are not available, even though bits have been added to the buffer at the maximum bitrate $R_{Max}$. (The bits are not available because the bits cannot be added to the buffer at a rate exceeding $R_{Max}$.) To avoid an underflow situation, the encoder checks whether a particular encoded chunk of audio data is too large, i.e., whether drawing bits for the encoded chunk will cause underflow in the decoder buffer or will cause the decoder buffer to become too close to empty. If so, the encoder reduces the quality of the chunk, thereby reducing the number of bits and ameliorating the underflow situation. The encoder uses a regular rate control procedure to prevent buffer underflow, throttling down on local quality in proportion to how close the buffer is to empty.

The decoder buffer can safely be at full state without violating the peak bitrate constraint. Fullness is a limiting factor, but the encoder does not proportionally change quality as the buffer gets full. Instead, if the buffer is full, filling stops until there is more room in the buffer. According to the model, the entity filling the decoder buffer waits for room to be available in the decoder buffer, ready to fill the buffer at the maximum rate $R_{Max}$. (This is different from the CBR model, in which the decoder buffer can be at full state, but that condition is unsafe due to the chance of buffer overflow, since the entity filling the buffer cannot stop and wait for room in the buffer.)

Mathematically, the decoder buffer is initially specified as follows.

$$BF_0=BF_{Max} \quad (11).$$

When a decoder removes a compressed chunk n from the decoder buffer with fullness $BF_{n-1}$, the buffer fullness becomes:

$$BF_n=BF_{n-1}-Bits_n \quad (12),$$

where $Bits_n$ is the size of compressed chunk n in number of bits.

To test the peak bitrate constraint, the encoder checks the buffer fullness following tentative removal of the bits for compressed chunk n. If $BF_n$ is negative or too close to empty, there is an actual or potential underflow violation, and the encoder reduces the target quality for the chunk. For example, the encoder uses a technique for avoiding buffer underflow as described in U.S. patent application Ser. No. 10/017,694, filed Dec. 14, 2001, entitled "Quality and Rate Control Strategy for Digital Audio," published on Jun. 19, 2003, as Publication No. US-2003-0115050-A1, the disclosure of which is hereby incorporated by reference. Alternatively, the encoder uses another technique to avoid buffer underflow.

$T_n$ is the presentation duration for chunk n. The buffer fullness at the end of presentation of that chunk is updated to be:

$$BF_n=\min(BF_n+R_{Max}\cdot T_n, BF_{Max}) \quad (13).$$

The encoder then continues with the next chunk.

Alternatively, the encoder uses a different decoder buffer model, for example one modeling different or additional constraints. Or, the encoder tests different or additional conditions for the peak bitrate constraint. In still other embodiments, the encoder does not consider a peak bitrate constraint at all.

4. Estimating Target Quality to Produce Total Number of Bits

When the target total number of bits $Bits_{Total}$ for the entire clip is established, the goal of the encoder is to encode the input with as uniform quality as possible while producing a number of bits close to the target total number $Bits_{Total}$. At the same time, the encoder satisfies the peak bitrate constraint, if that constraint is present.

At a particular stage of encoding before or during the second pass, suppose $Bits_{Committed}$ is the number of bits that have already been committed. The goal of the encoder is to spread the remaining bits $Bits_{Available}=Bits_{Total}-Bits_{Committed}$ among the remaining chunks in the second pass.

Figure 12:
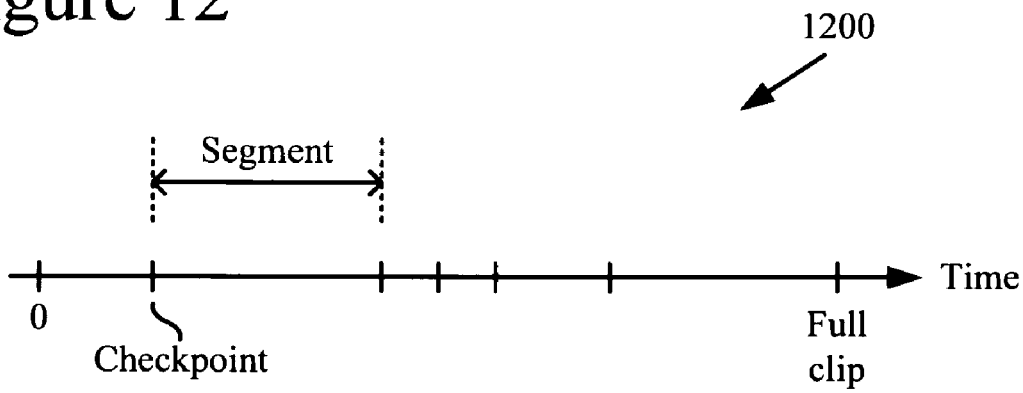
FIG. 12 is a chart showing checkpoints along a sequence of audio data.

The bits produced by actual encoding in the second pass can be different from the estimated number of bits, so the encoder places several checkpoints along the sequence. FIG. 12 shows a chart (1200) of checkpoints along a sequence of audio data. At the checkpoints, the encoder refines estimates and adjusts the target quality.

In one embodiment, as described below, the encoder places checkpoints at equally spaced positions in the total number of bits (e.g., 10% of $Bits_{Total}$, 20% of $Bits_{Total}$, etc.). As a result, as shown in FIG. 12, the checkpoints are not necessarily uniformly spaced over time. The encoder dynamically repositions the checkpoints during the second pass. Alternatively, the encoder sets checkpoints by other criteria such as every x chunks or every y seconds and/or the encoder sets checkpoints statically.

The encoder uses a single target quality per segment of the sequence, where a segment is a portion of the sequence between two adjacent checkpoints. At the start of the sequence and at each checkpoint, the encoder computes target quality. The determination of target quality is based on the assumption that all the future segments are coded at the same target quality.

a. Generalized Technique

Figure 13:
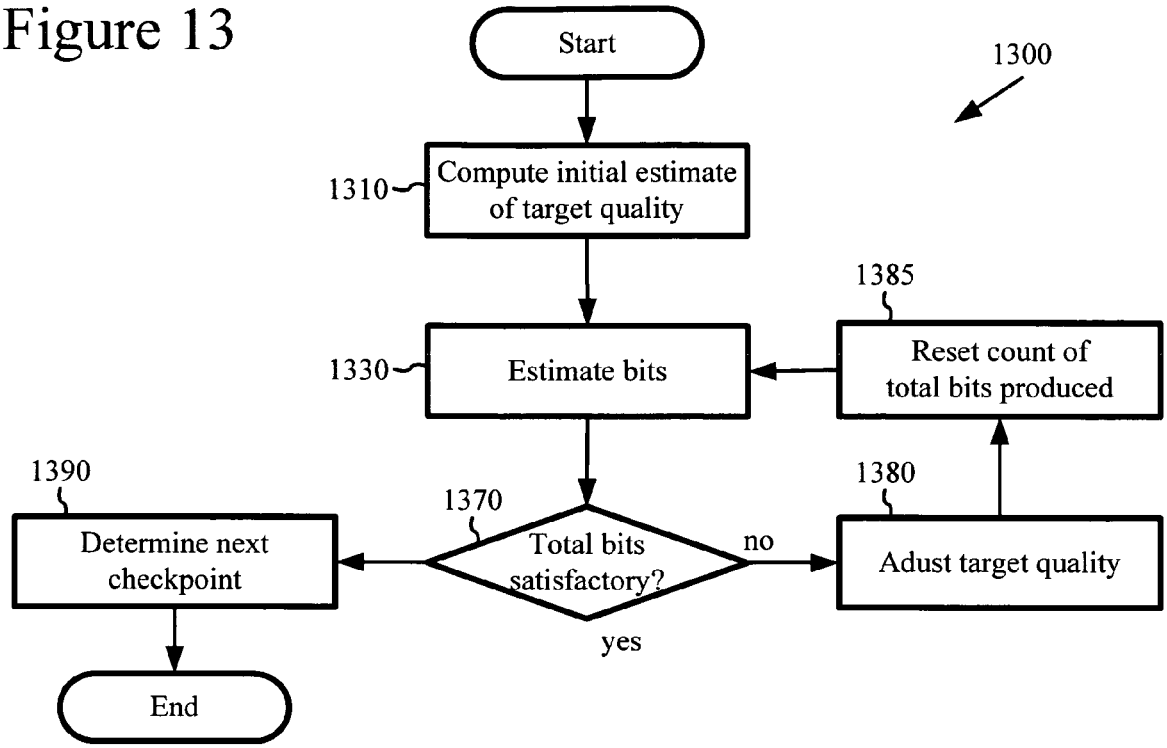
FIGS. 13 and 14 are flowcharts showing techniques for computing a target quality for a segment of a sequence of audio data.

FIG. 13 shows a generalized technique (1300) for computing a target quality. The encoder performs the technique (1300) for the first segment in a sequence of audio data, and again to adjust the target quality for later segments. To compute a target quality level according to the technique (1300), the encoder tests one or more target quality levels, using the statistics stored from the first pass, to converge on a satisfactory target quality level for the remainder of the sequence. The encoder will then use the target quality level for the current segment.

For a given segment, the encoder computes (1310) an initial estimate of target quality. For the first segment, the initial guess of target quality is based on the average target bitrate and complexity measures of the input, as measured in the first pass. For segments other than the first segment, the initial guess of target quality is the final quality setting of the preceding segment. Alternatively, the encoder uses other criteria to compute an initial guess of target quality.

Next, the encoder estimates (1330) bits for the sequence. For a given target quality setting, the encoder computes a quantization step size for a chunk. The encoder then estimates the number of bits produced for the chunk at the quantization step size. In this way, the encoder estimates the number of bits for each remaining chunk in the sequence at the target quality setting. Alternatively, the encoder uses another technique to predict the number of bits at a given target quality setting. The estimate of the total number of bits may include an actual count of bits for any chunks that have already been encoded in the second pass.

After estimating (1330) the total number of bits for the sequence, the encoder determines (1370) whether the number of bits is satisfactory, for example, within a threshold of the target total number of bits $Bits_{Total}$. The encoder may test other conditions as well.

If the number of bits is satisfactory, the encoder determines (1390) the next checkpoint (which may be the end of the sequence) and begins the second pass for the current segment with the given target quality setting.

Otherwise, the encoder adjusts (1380) the target quality up or down, for example, adjusting the target quality in proportion to the difference between the estimated number of bits and the target total number of bits $Bits_{Total}$. Alternatively, the encoder uses another algorithm to change the target quality. The encoder reduces the target quality if the number of total bits produced is above budget, and increases quality otherwise. The encoder then resets (1385) the total number of bits and repeats the process with the adjusted target quality setting. In this manner, the encoder converges on a satisfactory target quality setting.

Alternatively, instead of estimating bits for the entire sequence, the encoder estimates bits only for the segment for which target quality is being computed. The encoder then compares the estimated bits to the number of bits allocated for that segment. Or, instead of computing a single target quality setting, the encoder computes a number of bits per chunk or quantization step size per chunk that results in relatively uniform quality for the segment.

b. Detailed Technique

Figure 14:
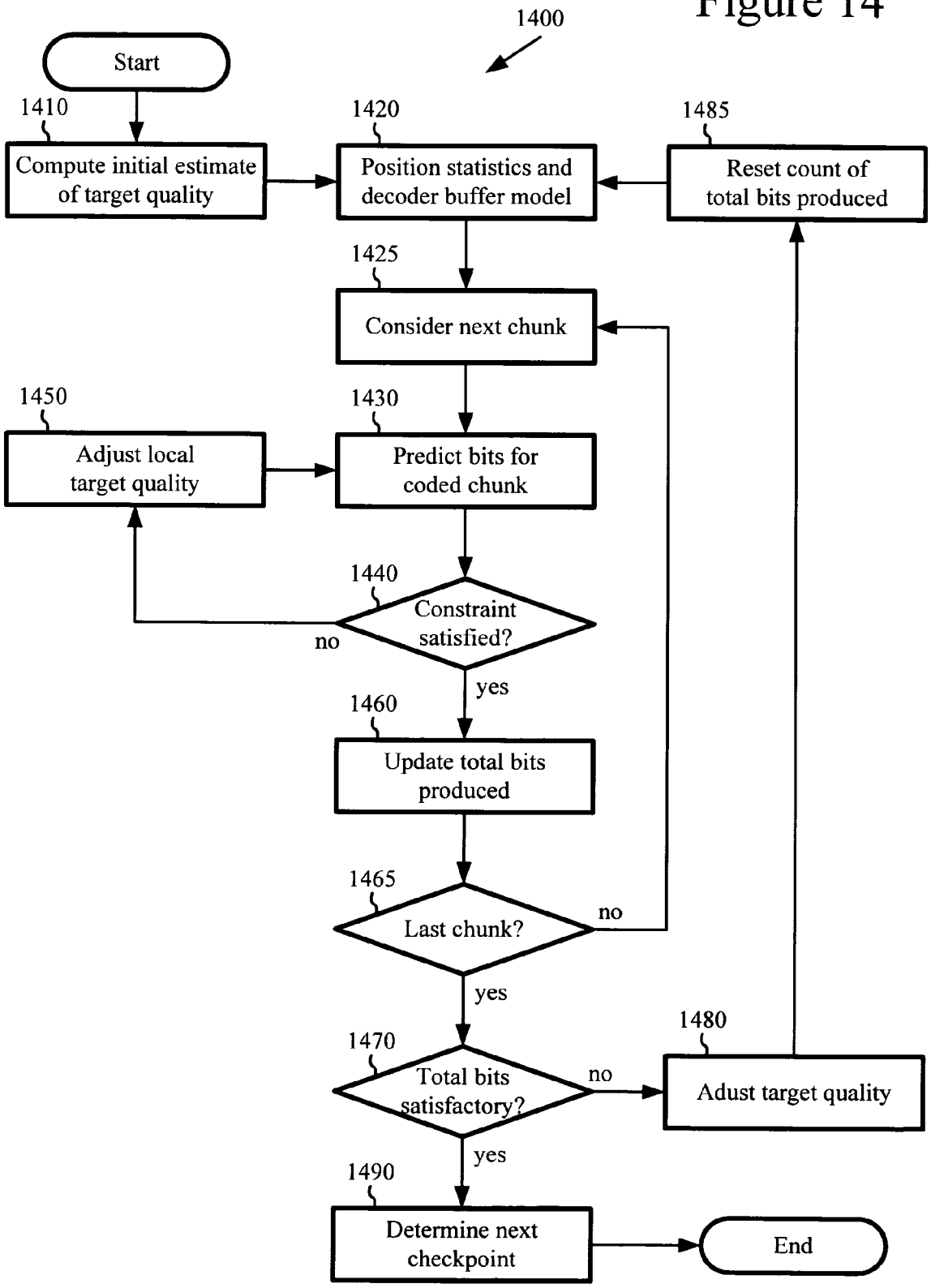

FIG. 14 shows a more detailed technique (1400) for computing a target quality, including testing a peak bitrate constraint. The encoder performs the technique (1400) for the first segment in a sequence of audio data, and again to adjust the target quality for later segments. To compute a target quality level, the encoder tests one or more target quality levels across the sequence, using (Step, Bits, Quality) triplets stored from the first pass, to converge on a satisfactory target quality level for the remainder of the sequence. The encoder will then use the target quality level for the current segment.

For a given segment, the encoder computes (1410) an initial estimate of target quality. For the first segment, the initial guess of target quality is based on the average target bitrate and complexity measures of the input, as measured in the first pass. The complexity measures are based on the average products of NER×bits for the chunks of the sequence. For segments other than the first segment, the initial guess of target quality is the final quality setting of the preceding segment.

The encoder positions (1420) statistics and the decoder buffer model to the correct location in the sequence of audio data, in essence "rewinding" the sequence to the proper location to begin the target quality computation. The encoder potentially performs the technique (1400) from anywhere in the sequence. For example, if the encoder performs the technique (1400) after encoding the first minute of a sequence in the second pass, the encoder positions (1420) the statistics and the decoder buffer model to their proper positions as of one minute into the sequence. At the start of the sequence, the decoder buffer is presumed to be full.

The encoder then considers (1425) data for the next chunk in the sequence. For example, the encoder considers the statistics and input bytes for the chunk. To start, the encoder considers the statistics and input bytes of the first chunk of the current segment. Later, the encoder incrementally changes the position to consider the statistics of the next chunk in the current segment.

The encoder then predicts (1430) bits for the current chunk. The encoder computes a quantization step size for a chunk at the given target quality setting following equations (5) and (6). The encoder then estimates the number of bits produced for the chunk at the quantization step size following equations (9) and (10).

To determine (1440) whether the peak bitrate constraint is satisfied, the encoder checks the model of the decoder buffer to simulate removal of the predicted number of bits by a decoder. Specifically, the encoder determines (1440) whether the peak bitrate constraint is satisfied, for example, as described above, by checking for an actual or potential underflow in the decoder buffer. For the target quality for the first segment, the encoder skips modeling the decoding buffer and testing the peak bitrate constraint. Or, the encoder may completely disable the peak bitrate constraint and decoder buffer modeling for a given sequence, for example, according to a user setting.

If the encoder detects an actual or potential underflow, the encoder adjusts (1450) the local target quality based on the decoder buffer fullness. If the decoder buffer is too low, the encoder reduces the local target quality slightly so that fewer bits are generated by the current chunk than are generated at the global target quality, as described above. The encoder then predicts (1430) bits for the current chunk at the locally adjusted quality level.

On the other hand, if the peak bitrate constraint is satisfied, the encoder updates (1460) the total bits produced. The total bits produced accounts for the bits already committed in encoding any preceding segments as well as the bits predicted for the remaining chunks in the sequence.

The encoder determines (1465) whether the current chunk is the last chunk in the sequence. If not, the encoder considers (1425) the next chunk, repeating the prediction for the next chunk.

If the current chunk was the last chunk, the encoder determines (1470) whether the total number of bits is satisfactory. For example, the encoder determines whether the predicted number of bits through the end of the sequence is within a threshold (such as 1.5%) of the total number of bits $Bits_{Total}$. The encoder may also exit the loop if the range of target quality levels reaches a threshold "tightness." For example, if the candidate NER values to the left and right are within a threshold such as 1%, the encoder accepts the solution and stops iterating through target quality levels.

If the total number of bits is satisfactory, the encoder determines (1490) the next checkpoint (which may be the end of the sequence). The encoder then begins (or continues) the second pass for the segment with the final target quality setting.

If the total number of bits is not satisfactory, the encoder adjusts (1480) the target quality up or down, reducing the target quality if the number of total bits produced is above budget, and increasing quality otherwise. Specifically, the encoder revises its estimates of the complexities of the chunks of the sequence (NER×bits for each chunk, in view of the revised numbers of bits) and adjusts the target quality accordingly, with the goal of the same target quality throughout the sequence. For example, suppose the current target quality is 0.05 (in terms of NER) and the average bitrate at that quality is 96 Kb/s. For a given target total size and duration, the target bitrate is 100 Kb/s, so the encoder adjusts the target quality to be 0.05×96/100=0.048, increasing the target quality slightly to increase the average bitrate. Or, suppose the average bitrate for the current target quality had been 104 Kb/s. The adjusted target quality would then be 0.05×104/100=0.052, decreasing the target quality slightly to decrease the average bitrate. For segments other than the very first segment, the encoder does not allow the target quality for the current segment to vary excessively (e.g., by more than 5%) from the preceding segment. The encoder then resets (1485) the total number of bits, positions (1420) the statistics and decoder buffer model at the beginning of the current segment, and repeats the process with the adjusted target quality setting. In this manner, the encoder converges on a satisfactory target quality setting.

5. Selecting Checkpoints/Segments

Since the two-pass VBR control strategy is based on modeling of the complexity of the input, there are inevitably some inaccuracies in the predictions of the number of bits to be produced. Thus, the encoder uses checkpoints to serve as points in the timeline when adjustments can be made to the control parameters.

In theory, the encoder could adjust control parameters at every input chunk. In view of the computational cost of doing so, however, and since there is no real need to adjust the control parameters so often, the encoder sets a smaller number of checkpoints $N_{CP}$, for example, 4, 10, 25, or 100.

Figure 15:
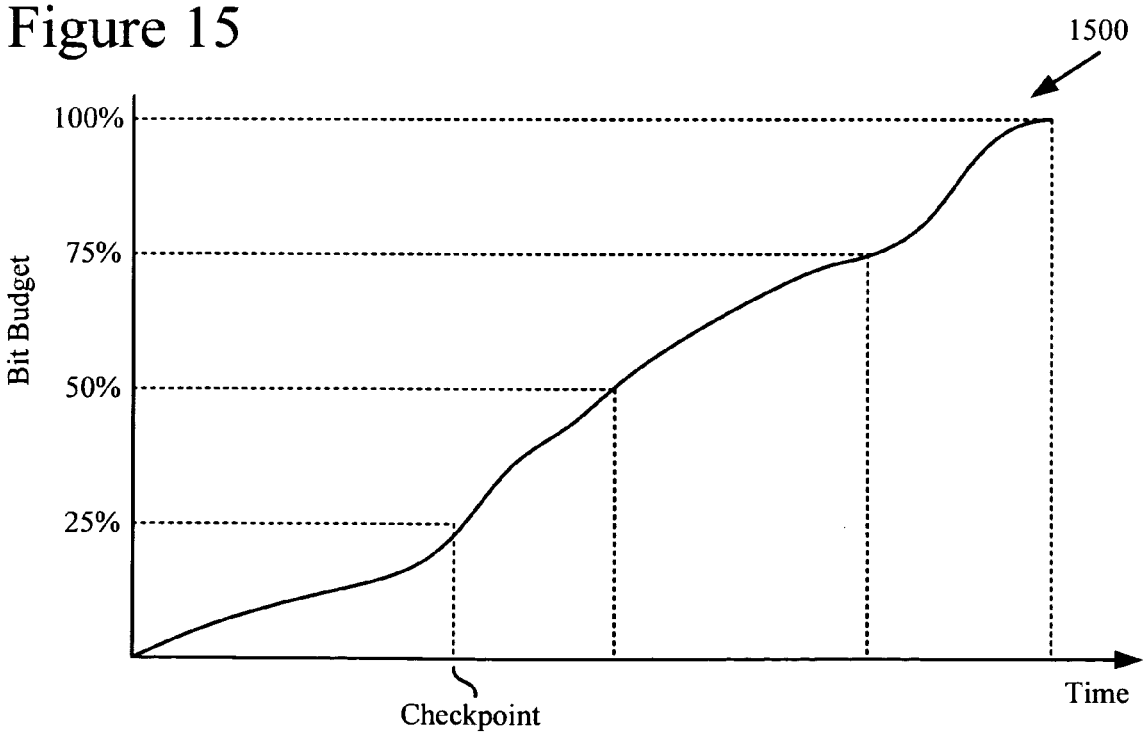
FIG. 15 is a chart showing checkpoints equally spaced by bits produced.

FIG. 15 shows a chart (1500) of cumulative bit generation over time, including four checkpoints that are equally spaced in terms of the bit budget for a sequence. The first checkpoint occurs when 25% of the bit budget is expected to be reached. In other words, the first checkpoint is chosen as the point in the timeline when the modeled cumulative bits produced up to that time equal the total bit budget (i.e., the file size) for the entire clip divided by $N_{CP}=4$. Similarly, the encoder places other checkpoints in the timeline at multiples of the total bit budget divided by $N_{CP}$.

The description of a checkpoint includes the expected bits CumulativeBits at the checkpoint as well as the point CumulativeTime in the timeline where the checkpoint is expected to occur. Mathematically, the cumulative bits generated and cumulative time are computed recursively through:

$$\text{CumulativeBits}_0=0 \quad (14),$$

$$\text{CumulativeBits}_n=\text{CumulativeBits}_{n-1}+\text{Bits}_n \quad (15),$$

$$\text{CumulativeTime}_0=0 \quad (16),$$

and $$\text{CumulativeTime}_n=\text{CumulativeTime}_{n-1}+T_n \quad (17).$$

After the encoder reaches a checkpoint in the second pass, the encoder may adjust the positions for the remaining checkpoints, dynamically determining the next checkpoint. In essence, whenever either the time target or bits target of a checkpoint is met, the encoder determines a new set of checkpoints, meaning both the time and bits targets of the checkpoints are updated. For example, suppose the first checkpoint is at $\text{CumulativeBits}_{Checkpoint}=10\%\times\text{Bits}_{Total}$ and $\text{CumulativeTime}_{Checkpoint}=10$ s, and that the encoder reaches the first checkpoint when $\text{CumulativeBits}_{Checkpoint}=10\%\times\text{Bits}_{Total}$ and $\text{CumulativeTime}_{Checkpoint}=9$ s. The encoder removes the first checkpoint and sets a new, second checkpoint according to the model, for example, at $\text{CumulativeTime}_{Checkpoint}=18$ s and $\text{CumulativeBits}_{Checkpoint}=20\%\times\text{Bits}_{Total}$, whichever comes earlier. Alternatively, the encoder may compute all of the checkpoints before the second pass begins and not adjust the checkpoints.

Or, instead of setting checkpoints according to milestones in bits produced, the encoder sets checkpoints by other criteria such as every seconds or every x chunks, where x may be greater than 1 to reduce computational complexity.

C. Second Pass

In the second pass, the encoder encodes the sequence of audio data while regulating quality based upon the statistics gathered in the first pass. The encoder adjusts control parameters during the second pass to correct inaccuracies in prediction.

At the beginning of the second pass, the encoder has completed an analysis of the statistics gathered during the first pass. This analysis produces one or more control parameters such as a target quality for the sequence as well as checkpoints (in particular, a first checkpoint) in the sequence. Overall, the encoder uses the control parameters to encode the first segment (i.e., until either the time target or the bits target is met for the first checkpoint). The encoder then adjusts the control parameters and next checkpoint for the next segment, and encodes the next segment. The encoder repeats this process until the entire sequence has been encoded in the second pass.

More specifically, in the second pass, the encoding proceeds as under a one-pass, quality-based VBR control strategy. For example, the encoder (500) of FIG. 5 encodes the chunks of the sequence according to the target quality. The encoder adjusts quantization step size (and potentially other factors) for chunks to ensure uniform or relatively uniform quality of the encoded audio data. When the encoder has cached auxiliary information such as tile configurations, channel transforms, and mask values from the first pass, the encoder uses the stored information in the second pass to speed up the actual compression process in the second pass.

If a peak bitrate constraint applies, the encoder employs a model of a decoder buffer. Similar to the model of the decoder buffer in the target quality estimation stage, the model of the decoder buffer tracks buffer fullness to guard against actual and potential underflow situations. If the decoder buffer is close to empty or would be empty after encoding a chunk at a given quality setting, the encoder takes action to reduce the local target quality of the output.

During the second pass, the encoder maintains counts of the cumulative bits CumulativeBits and cumulative time CumulativeTime for the output being produced. The encoder compares these values against the bits and time values for the next checkpoint. If $\text{CumulativeBits} \geqq \text{CumulativeBits}_{Checkpoint}$ or if $\text{CumulativeTime} \geqq \text{CumulativeTime}_{Checkpoint}$, the encoder pauses actual compression of input to update the model and control parameters. The update generates a new target quality for the remainder of the input, to be used for the next segment. The update also generates an updated list of checkpoints.

The encoder continues this adaptive process until all of the input has been encoded and a complete output bitstream has been generated. Due to the use of checkpoints and adaptive refinement of control parameters such as target quality, the two-pass VBR control strategy successfully achieves uniform or relatively uniform quality throughout the sequence, while producing an output bitstream at or very close to the target total number of bits. In contrast, various prior solutions deviate substantially from the target total number of bits, or are forced to drastically alter quality at the end of the sequence to meet the target total number of bits.

D. Input Checking

In a typical two-pass encoding scheme, the encoder does not cache the input samples from the first pass for use in the second pass. Doing so could easily require too much additional memory or storage capacity. Instead, the encoder depends on an external source to feed the input to the encoder a second time for the second pass. The external source might involve other decoders, processes, or modules that do not necessarily provide consistent input in the two passes. This is not a problem under typical circumstances, in which the process does not require that input exactly match in the two passes. If auxiliary information generated during the first pass is to be used in the second pass, however, the input data should be consistent across the two passes. For this reason, the encoder may check the consistency of the input between the two passes.

Figure 16:
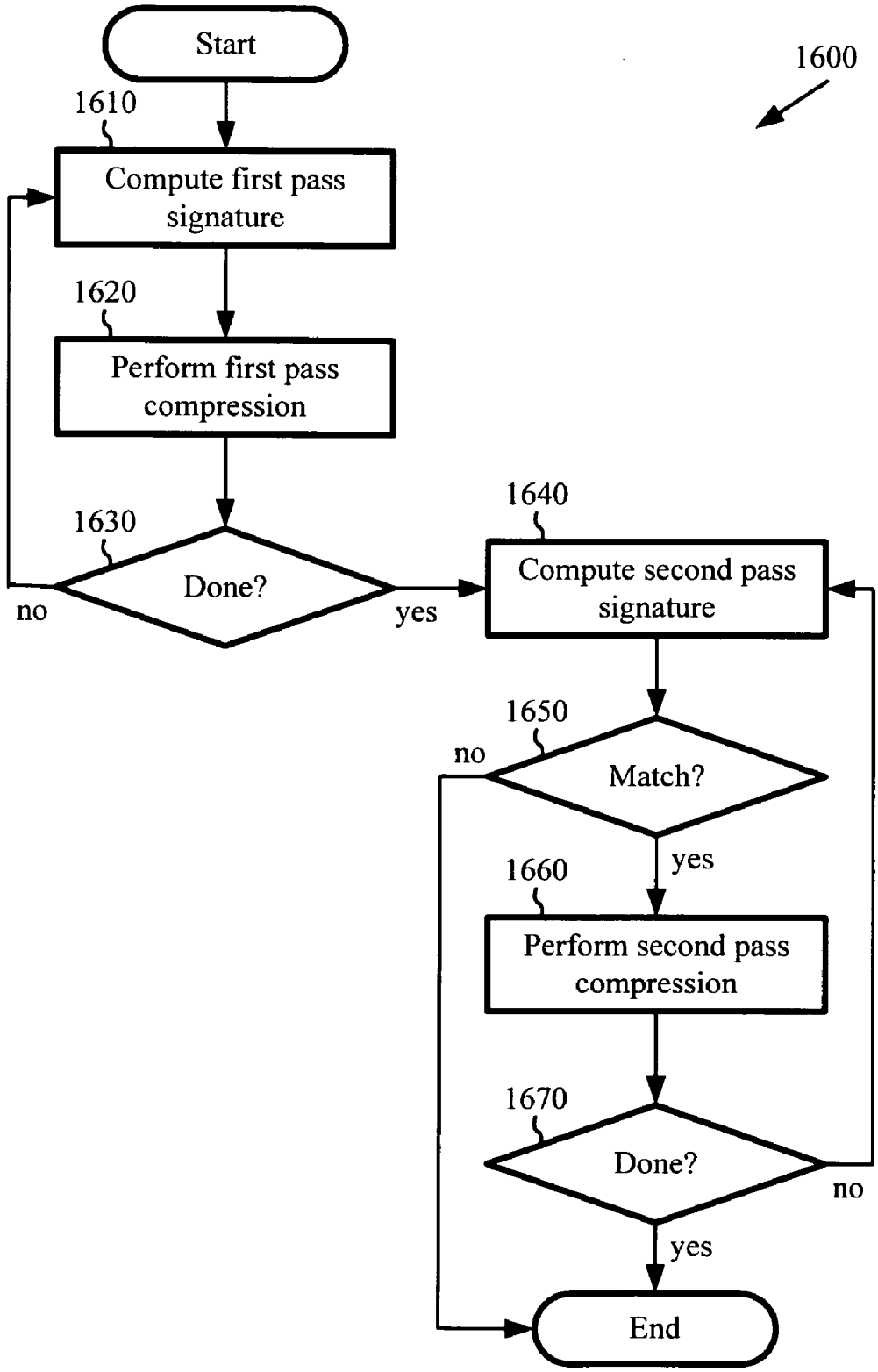
FIG. 16 is a flowchart showing a technique for checking the consistency of the input between the first and second passes.

FIG. 16 shows a technique (1600) for checking the consistency of input between passes. In the technique (1600), to validate that the input is consistent between passes, the encoder produces a "signature" of the input data in the first pass and stores the signature along with other statistics. In the second pass, the signature of the input data is computed and compared against the signature of the input data from the first pass. If the signatures disagree, the encoder stops encoding in the second pass or switches to a mode in which cached auxiliary information is not used.

In the first pass, the encoder computes (1610) a signature for a portion of the input and performs (1620) first pass compression for that portion of the input. For example, the portion is a chunk of audio data, and the signature is an XOR of the input bytes for the chunk. Alternatively, instead of XOR of input bytes, the encoder computes a different signature. Or, instead of computing signatures for chunks, the encoder computes signatures for portions of different size than chunk.

The encoder determines (1630) whether the first pass is done. If not, the encoder continues with the next portion in the first pass. Otherwise, the encoder finishes the first pass.

In the second pass, the encoder computes (1640) a signature for a portion of the input, where the signature is computed with the same technique, and the portion is the same size, as in the first pass encoding. The encoder determines (1650) whether the signatures match for the portion. If so, the encoder performs (1660) second pass compression for that portion of the input. If the two signatures do not match, the encoder takes an alternative action. For example, the encoder stops the second pass and reports the signature problem to the user. This prevents the encoder from generating a bad output stream based on the inconsistent input, since the cached auxiliary information to be used in the second pass may be incorrect for the actual input to the second pass.

The encoder determines (1670) whether the second pass is done. If not, the encoder continues with the next portion in the second pass. Otherwise, the encoder finishes the second pass.

Having described and illustrated the principles of our invention with reference to various embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In a computer system, a computer-implemented method of media encoding according to a multi-pass variable bitrate control strategy, the method comprising:

in a first pass, encoding multi-channel media data partitioned into plural variable-size chunks for the encoding, wherein the plural variable-size chunks are plural tiles of the media data;

processing results of the encoding in the first pass to determine one or more control parameters for the media data; and in a second pass, encoding the media data according to the one or more control parameters in view of a goal of uniform quality at variable bitrate.

2. The method of claim 1 wherein the media data are audio data.

3. The method of claim 1 wherein the processing includes computing a checkpoint, and wherein the encoding in the second pass includes checking results of the encoding in the second pass at the checkpoint.

4. The method of claim 3 further comprising, at the checkpoint in the second pass, adjusting the one or more control parameters and computing a subsequent checkpoint.

5. The method of claim 1 wherein a peak bitrate constraint affects quality and bitrate in the second pass.

6. The method of claim 1 wherein a target total bit count constrains the one or more control parameters in view of complexity of the media data.

7. The method of claim 1 further comprising using auxiliary information from the encoding in the first pass in the encoding in the second pass to increase speed of the encoding in the second pass.

8. The method of claim 1 wherein the encoding in the first pass includes encoding at least part of the media data at plural different quality settings.

9. The method of claim 1 wherein the encoding in the first pass includes computing triplets for the plural variable-size chunks, wherein each of the triplets includes a value for each of quantization step size, bits, and quality setting.

10. The method of claim 1 wherein the one or more control parameters include a target quality setting.

11. The method of claim 1 further comprising repeating the processing during the encoding in the second pass such that the one or more control parameters influence and are influenced by the encoding in the second pass.

12. The method of claim 1 further comprising comparing signatures for the first and second passes, wherein the signatures for the first and second passes comprise a first value and a second value, respectively, derived from input for a portion of the media data, wherein the comparing checks that the input is consistent between the first pass and the second pass, and wherein the encoding in the second pass ends if the signatures indicate a discrepancy in the media data between the first and second passes.

13. The method of claim 1 wherein plural windows from different channels of frames of the media data are grouped into the plural tiles, and wherein each tile of the plural tiles groups one or more co-located windows of the same size among the plural windows from the different channels of the frames of the media data.

14. In a computer system, a computer-implemented method of audio encoding according to a multi-pass variable bitrate control strategy, the method comprising:

in a first pass, encoding audio data, including computing triplets for plural chunks of the audio data, wherein each of the triplets includes a value for each of quantization step size, bits, and quality setting; and in a second pass, encoding audio data to produce variable bitrate output at a target quality level.

15. The method of claim 14 wherein the encoding in the first pass includes computing three or more triplets for at least one of the plural chunks.

16. The method of claim 14 wherein the encoding in the first pass includes computing triplets for a given one of the plural chunks until the computed triplets describe a useful range of a step-rate-distortion pattern for the given chunk.

17. In an audio encoder, a computer-implemented method of audio encoding according to a multi-pass variable bitrate control strategy, the method comprising:

in a first pass, encoding a sequence of multi-channel audio data, wherein the sequence includes plural chunks, and wherein the plural chunks are tiles of the audio data; and in a second pass, encoding the sequence of audio data in view of a goal of uniform quality at variable bitrate, wherein the encoding in the second pass includes checking results at each of plural checkpoints, and wherein each of the plural checkpoints is separated from other checkpoints by at least two chunks.

18. The method of claim 17 wherein the checkpoints are set at defined points of progression towards a target total bit count for the sequence.

19. The method of claim 17 further comprising adjusting the checkpoints during the second pass.

20. The method of claim 17 further comprising adjusting a target quality at one or more of the plural checkpoints to improve uniformity of quality in the sequence.

* * * * *